United States Patent [19]

Moorer

[11] 4,215,617

[45] Aug. 5, 1980

[54] MUSICAL INSTRUMENT AND METHOD FOR GENERATING MUSICAL SOUND

[75] Inventor: James A. Moorer, Saratoga, Calif.

[73] Assignee: The Board of Trustees of Leland Stanford Junior University, Palo Alto, Calif.

[21] Appl. No.: 743,612

[22] Filed: Nov. 22, 1976

[51] Int. Cl.[2] ..... G10F 1/00

[52] U.S. Cl. ..... 84/1.03; 84/1.01; 84/1.24

[58] Field of Search ..... 84/1.11, 1.03, 1.01, 84/1.13, 1.24, 1.26

[56] References Cited

U.S. PATENT DOCUMENTS

| | | | |
|---|---|---|---|
| 4,003,003 | 1/1977 | Haeberlin | 84/1.01 |
| 4,018,121 | 4/1977 | Chowning | 84/1.01 |

*Primary Examiner*—J. V. Truhe
*Assistant Examiner*—L. W. Pojunas, Jr.
*Attorney, Agent, or Firm*—David E. Lovejoy

[57] ABSTRACT

Disclosed is a musical instrument and method for generating musical sound. Digital circuits produce a sequence of numbers which are converted to analog electrical signals which are periodically sampled to drive a conventional speaker. The digital circuits operate in accordance with a method of forming each sample by evaluation of a closed-form expression including a first function of time, either periodic or non-periodic, transformed by a second function of time where the second function is non-linear, non-sinusoidal and differs from the first function. The frequency spectra of the resulting musical sound can be finite and the amplitudes of frequency components do not have unwanted limitations.

16 Claims, 14 Drawing Figures

MUSICAL INSTRUMENT AND METHOD FOR GENERATING MUSICAL SOUND

CROSS REFERENCE TO RELATED APPLICATION

METHOD OF SYNTHESIZING A MUSICAL SOUND, Ser. No. 573,933, filed May 2, 1975 as a continuation-in-part of application Ser. No. 454,790, filed Mar. 26, 1974, (now abandoned) both invented by John M. Chowning and assigned to the Board of Trustees of Leland Stanford Junior University, now U.S. Pat. No. 4,018,121, issued Apr. 19, 1977.

BACKGROUND OF THE INVENTION

This invention relates to musical instruments and more specifically to digitally controlled electronic instruments and methods for generating musical sound.

Digitally controlled methods of generating musical sound operate by producing a sequence of coded digital numbers which are converted to electrical analog signals. The analog signals are amplified to produce musical sound through a conventional speaker. Musical instruments which employ digital control are constructed with a keyboard or other input device and with digital electronic circuits responsive to the keyboard. The electronic circuits digitally process signals initiated by the keyboard and thereby digitally control the oscillations which form the sound in the speaker. These digitally controlled oscillations are distinguished from analog controlled oscillations generated by electronic oscillators and are distinguished from mechanically induced oscillations produced by conventional orchestral instruments.

All musical sounds, whether of electronic or mechanical origin, can be described by Fourier spectra. The Fourier spectra describes musical sound in terms of its component frequencies which are represented as sinusoids. The whole musical sound is therefore a sum of the component frequencies, that is, a sum of sinusoids.

Under Fourier analysis, tones are classified as harmonic or inharmonic. A harmonic tone is periodic and can be represented by a sum of sinusoids having frequencies which are integral multiples of a fundamental frequency. The fundamental frequency is the pitch of the tone. Harmonic instruments of the orchestra include the strings, the brasses, the woodwinds, the piano, and many more. An inharmonic tone is not periodic although it often can be represented by a sum of sinusoids. The frequencies comprising an inharmonic tone, however, usually do not have any simple relationship. Inharmonic instruments do not normally have any pitch associated with them. Instruments in the orchestra that are inharmonic include the percussion instruments, such as the base drum, the snare drum, and the cymbal and others.

Electronically controlled musical instruments have relied upon forming selected Fourier spectra as a basis for producing musical sound. One known type of digital musical instrument employs a harmonic summation method of music generation. In the harmonic summation method, a tone is produced by adding together a number of amplitude-scaled sinusoids of different frequencies. The harmonic summation method, however, requires a complex addition process to form each sample. That addition process requires digital circuitry which is both expensive and inflexible. Accordingly, the digital design necessary to carry out the method of harmonic summation leaves much to be desired.

Another known type of musical instrument employs the filtering method of music generation. In the filtering method, a complex electrical wave form, such as a square wave or a saw tooth pulse train, is filtered by one or more filters to select the desired frequency components. Thereafter, the filtered frequency components are combined to form the electrical signal which drives the speaker. The filtering method is commonly used to synthesize human speach and has often been used with analog electronic organs. The filtering method is comparatively expensive and inflexible since each sample cannot be produced independently of the previous sample and hence prior sample values must be stored. Also, the filtering method requires a large number of multiplication steps which are not economically performable.

Both the harmonic summation and the filtering methods rely upon a linear combination of sinusoids and hence they are characterized as linear methods. The linear property is apparent from the fact that multiplying the amplitude of the input function (sinusoids for harmonic summation or a pulse train for filtering) by a factor of two results in an output waveform with the same tone quality and with an amplitude multiplied by a factor of two.

The above cross-referenced Chowning application describes a non-linear method for electronically controlling the generation of musical sound. That nonlinear method employs a closed-form expression (based upon frequency modulation) to represent the sum of an infinite number of sinusoids. That non-linear frequency modulation method produces a number of sinusoids which have frequencies which are the sum of the carrier frequency and integral multiples of the modulation frequency. The amplitudes of the multiples of the modulation frequency, however, are constrained to be sums of Bessel functions.

While the non-linear frequency modulation method of Chowning is a significant improvement over the linear harmonic summation and filtering methods, improved methods of musical sound generation are still needed. For example, it is desirable to remove the requirement that the amplitudes of frequency components be constrained to the Bessel functions. Furthermore, it is desirable at times that finite spectra be utilized, that is, a spectra composed of the sum of a finite number of sinusoids.

In accordance with the above background, it is an objective of the present invention to provide an improved musical instrument and method of generating sound which employs an improved digital, non-linear method of producing spectra where the spectra can be finite and the amplitudes of frequency components do not have unwanted limitations.

SUMMARY OF THE INVENTION

The present invention is a musical instrument and a method of producing musical sound. The musical instrument includes a keyboard or other input device, digital circuitry for controlling the generation of sound by producing digital numbers, a digital-to-analog converter for converting the numbers to analog signals, and an audio output responsive to periodic samples from the converter for generating musical sound. The musical instrument operates in accordance with a non-linear method in which a first function of time is transformed non-linearly by a second function of time where the second function is non-sinusoidal and is different from the first function. The non-linear method permits each sample to be calculated independently of the values of other samples, permits the spectra of the audio output to be finite and permits the amplitudes of the sinusoids forming the spectra to be free of unwanted amplitude constraints.

A musical instrument in accordance with one preferred embodiment of the present invention, includes a first function memory for storing the first function of time and one or more second function memories for storing one or more second functions of time. In addition to the first and second function memories, the instrument includes an amplitude control unit, a spectral control unit, and an initial data memory, a scratch pad memory, a multiplier, an adder, and a control unit.

The initial data memory stores parameters which define the sequence number (S), the center frequency (Fc), the modifying frequency (Fm), and where employed, the number of sidebands (N). The control unit functions to execute control sequences which are typically defined by program steps. The control unit causes the various units to be accessed to provide a step wise nonlinear transformation of the first function by the second function. Each step of the transformation provides a number to the digital-to-analog converter. The converter is sampled at a fixed rate to produce an analog signal to drive the audio output. The resulting musical sound has a frequency spectra which may accurately represent the common orchestral sounds as well as many other musical sounds.

In accordance with the above summary, the present invention achieves the object of providing an improved musical instrument and method of forming musical sound which employs a non-linear transformation of a first function by a second different function.

The foregoing and other objects, features and advantages of the invention will be apparent from the following more particular description of preferred embodiments of the invention, as illustrated in the accompanying drawings.

DETAILED DESCRIPTION

Theoretical Basis of Operation

Figure 1:
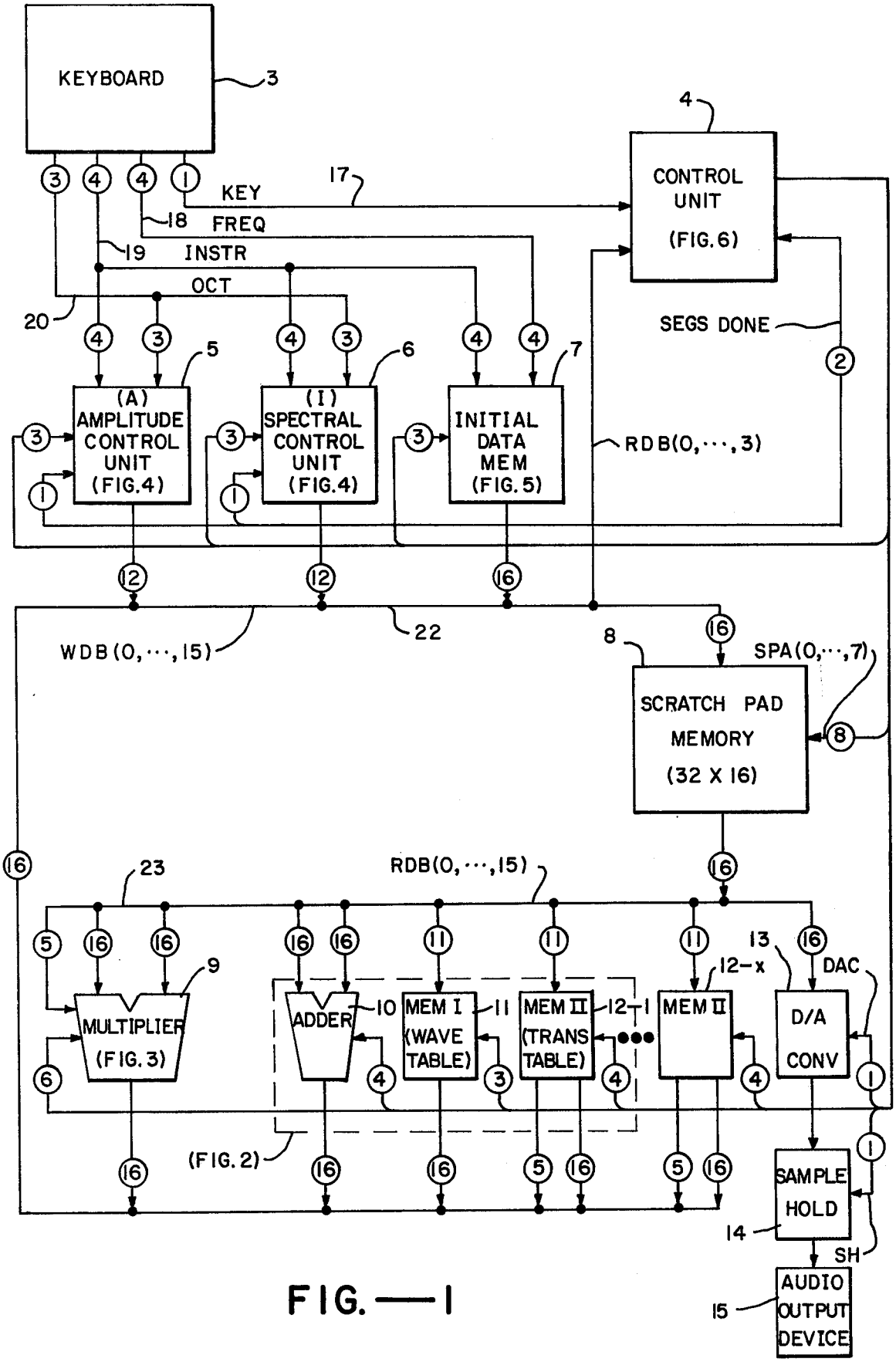
FIG. 1 depicts a schematic electrical block diagram of a musical instrument in accordance with the present invention.

In FIG. 1, the keyboard 3 is similar to the keyboard of a piano or an organ. The player of the keyboard selects an "instrument" which specifies a desired tone quality and then plays the keys like a piano or an organ. When a key of the keyboard is depressed, the object is to produce a sound of the selected quality from the audio output device 15. The electrical circuitry between the keyboard 3 and the audio output device 15 functions to produce a series of digital numbers which responsively control the production of the desired musical sound.

The method by which the electronic circuitry of FIG. 1 produces the desired series of digital numbers is based upon controlling the sinusoidal components in the Fourier spectra. The manner in which the sinusoidal components are selected is defined in part by anyone of the following equations:

$$\sum_{k=0}^{\infty} a^k \sin(\theta+k\beta) = \frac{\sin(\theta) - a\sin(\theta-\beta)}{1+a^2-2a\cos(\beta)} \quad \text{Eq. (1)}$$

$$\sum_{k=0}^{N} a^k \sin(\theta+k\beta) = \frac{\sin(\theta) - a\sin(\theta-\beta) - a^{N+1}[\sin\{\theta+(N+1)\beta\} - a\sin(\theta+N\beta)]}{1+a^2-2a\cos(\beta)} \quad \text{Eq. (2)}$$

$$\sin(\theta) + \sum_{k=1}^{N} a^k\{\sin(\theta+k\beta)+\sin(\theta-k\beta)\} = \frac{\sin(\theta)\,(1-a^2-2a^{N+1}[\cos\{(N+1)\beta\} - a\cos(N\beta)])}{1+a^2-2a\cos(\beta)} \quad \text{Eq. (3)}$$

$$\sin(\theta) + \sum_{k=1}^{\infty} a^k\{\sin(\theta+k\beta)+\sin(\theta-k\beta)\} = \frac{(1-a^2)\sin(\theta)}{1+a^2-2a\cos(\beta)} \quad \text{Eq. (4)}$$

$$\sum_{k=0}^{\infty} \frac{a^k}{k!} \sin(\theta+k\beta) = e^{a\cos\beta}\sin(\theta+a\sin\beta) \quad \text{Eq. (5)}$$

$$I_o(a)\sin\theta + \sum_{k=1}^{\infty} I_k(a)\,\{\sin(\theta+k\beta)+\sin(\theta-k\beta)\}\,e^{a\cos\beta}\sin\theta \quad \text{Eq. (6)}$$

$$\sum_{m=0}^{\infty}\sum_{k=0}^{\infty} \frac{1}{2} J_k(a)\,I_m(b)\,\{\cos(\theta+k\beta-m\gamma)-\cos(\theta+k\beta+m\gamma)\} + \sum_{m=0}^{\infty}\sum_{k=1}^{\infty} \frac{1}{2} J_k(a)I_m(b)\,\{\cos(\theta-k\beta-m\gamma) - \cos(\theta-k\beta+m\gamma)\} = e^{b\cos\gamma}\sin(\theta+a\sin\beta) \quad \text{Eq. (7a)}$$

$$\frac{5}{2}(a-4a^3+3a^5)\,\{\cos(\theta-\beta) - \cos(\theta+\beta)\} \quad \text{Eq. (7b)}$$

$$\frac{5}{2}(a^3-a^5)\,\{\cos(\theta-3\beta) - \cos(\theta+3\beta)\}$$

$$\frac{1}{2}a^5\{\cos(\theta-5\beta) - \cos(\theta+5\beta)\} = C_5(a\sin\beta)\sin\theta$$

Each of the above equations involves a summation of sinusoidal terms which, if properly employed in a music instrument, will produce musical sound with a desired Fourier spectra. In the above equations, each of the expressions on the left-hand side of the equal sign involves either an infinite or a finite sum of sinusoidal terms. Each of the expressions on the right-hand side of the equal sign involves a closed-form expression having a comparatively small, fixed number of terms in which one function is non-linearly transformed by another.

In order to utilize the right-hand expressions to form a digital musical instrument, the quantities $\beta$ and $\theta$ are replaced with quantities which have meaning in terms of digital circuitry. The quantity $\theta$ is replaced with the quantity $2\pi$(Fc)nT; the quantity $\beta$ is replaced with the quantity $2\pi$(Fm)nT; the quantity "a" is replaced by the quantity "I". The quantity (Fc) is the center frequency of the musical sound to be produced. The quantity (Fm) is the modifying frequency of the musical sound to be produced. The quantity "n" represents time which can be measured in terms of the number of samples which have been produced. The quantity "T" represents the sampling interval measured as the time between consecutive samples. The quantity "I" is the spectral index which is a number which varies as a function of the sample time "n". Each of the above equations can be additionally multiplied by an amplitude index, "A", which also is a number which varies as a function of the sample time "n". By making the indicated substitutions and multiplications into the above equations, each of the resulting equations defines an output wave form, "X", at a point in time "n" so that "X" varies as a function of "n".

By way of example, the expression for "X" derived from Eq. 1 above is as follows:

$$X(n) = A(n) \sum_{k=0}^{\infty} I(n)^k \sin\{2\pi(F_c + kF_m)nT\} \quad \text{Eq. (8)}$$

$$X(n) = A(n) \frac{\sin(2\pi F_c nT) - I(n)\sin\{2\pi(F_c - F_m)nT\}}{\{1 + I(n)^2 - 2I(n)\cos(2\pi F_m nT)\}}, \quad \text{Eq. (9)}$$

Where:

X(n)=X=wave form at time "n"
A(n)=A=amplitude index at time "n"
I(n)=I=spectral index at time "n"
Fc=center frequency
Fm=modifying frequency
n=time
T=sample period In Eq. (9), choosing the numbers Fc, Fm, and the two time-varying functions A and I, completely determines the wave form X. In order to understand how those choices define the spectra of a musical sound, an example of a brass-like tone will be described.

Brass tones are well known to be perfectly harmonic. A brass tone begins as almost a pure sinusoid and changes over the initial twenty to fourty milliseconds designated as the attack period, the higher harmonics grow smoothly from a zero amplitude until a steady-state value is reached. After the steady-state terminates, the decay portion occurs essentially as a reverse of the attack portion. From these well-known properties of a brass tone, it is desirable to select the functions in Eq. (9) which will achieve the indicated brass tone frequency spectra. In order to produce a brass-like tone, Fc must be made equal to Fm in Eq. (8) and Eq. (9) in order to produce a harmonic series. Also in Eqs. (8) and (9), I is constrained to a value less than 1.

It is apparent from inspection that, when I is equal to zero, Eq. (8) defines a pure sinusoid at the fundamental frequency Fc since the equation only has a non-zero value when k is equal to zero. Accordingly, in order to build a frequency spectra for a brass-like tone, the initial value of I for Eq. (8) or Eq. (9) is set to zero. In order to further build the brass-like tone, the value of I changes as a function of time "n". The spectral effect of changing I can be realized by examination of Eq. (8). When I is some number greater than zero, all of the harmonics of Fc from zero to infinity (the range of k) are present. The fundamental sinusoid resulting from k equal to zero in Eq. (8) is always present. Additionally, for I not equal to zero, each of the higher harmonics (k equals one through infinity) is present. The amplitudes of the higher harmonics decrease since the number $I^k$ decreases when k increases if I is less than 1. As the value of I increases from zero toward one, the amplitudes of the harmonics, $I^k$, approach the amplitude of the fundamental frequency Fc. Accordingly, an increase in the value of I as a function of time in Eq. (8) correspondingly causes an increase of the amplitudes of the higher harmonics relative to the amplitude of the fundamental. While this property is evident from Eq. (8), it is also true for Eq. (9) which is an equivalent expression.

It is evident from the above discussion that selection of values for I is effective to control the relative amplitudes of the frequency components which form the spectra of the wave form X. For this reason, the quantity I is designated as the spectral index.

In order to make a brass-like tone, the spectral index I starts at a zero value and grows continuously to a steady-state value. After the steady-state value, the spectral index I decreases from the steady-state value to a zero value. The initial increase of the spectral index is called the attack portion of the musical tone and the decrease of the spectral index is called the decay of the tone.

Figure 12:
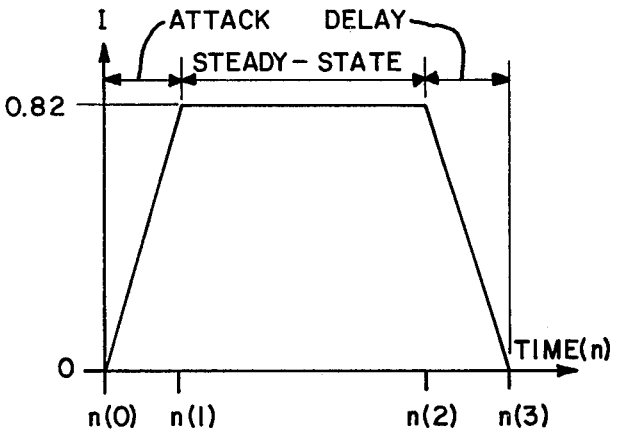
FIG. 12 depicts a wave form representative of the spectral index I as a function of time (n) for a brass-like tone.

Referring to FIG. 12, a spectral index I varying as a function of time (n) is shown for a brass-like tone. The attack portion is a linear slope from time n0 until time n1. At time n1, the spectral index reaches its steady-state amplitude of 0.82 and remains at the steady-state level until time n2. The decay portion occurs between time n2 and time n3 when the spectral index changes linearly from the steady-state value down to zero.

Figure 8:
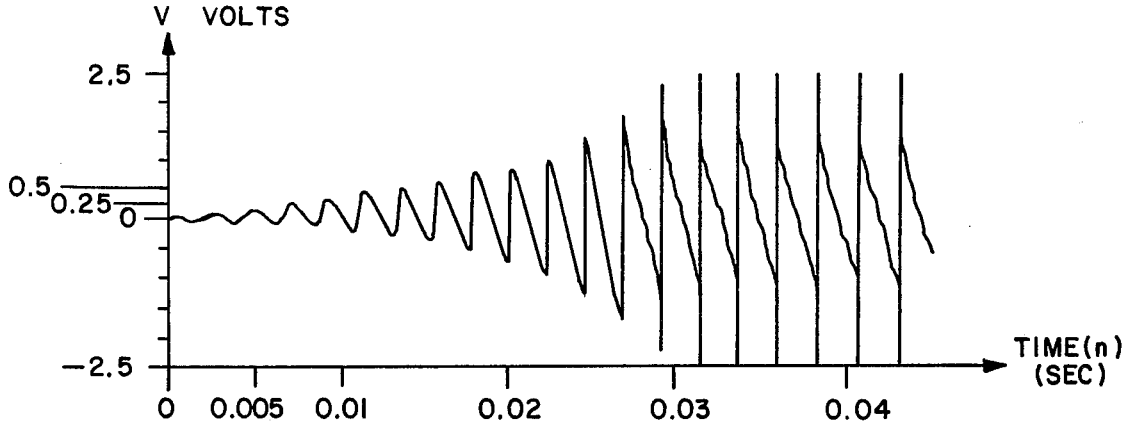
FIG. 8 depicts an expanded scale view of the attack portion of the wave form of FIG. 7.
Figure 13:
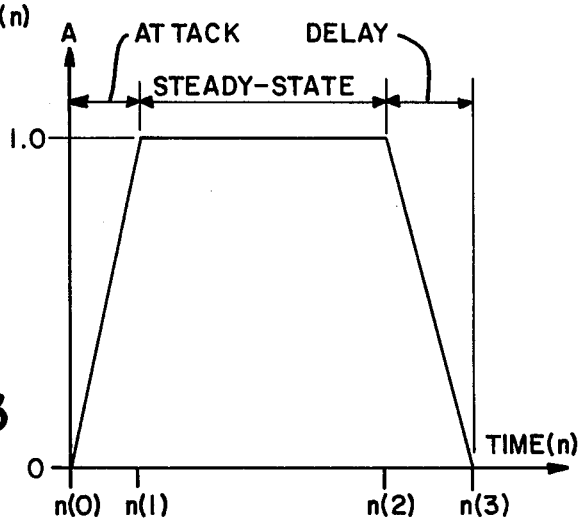
FIG. 13 depicts a wave form representative of an amplitude index A as a function of time (n) for a brass-like tone.

At the same time that the spectral index I is changing as shown in FIG. 12, the amplitude index, A, of FIG. 8 is also varying as a function of time (n). In FIG. 13, the amplitude index A is shown as a function of time (n). During the attack portion from n0 to n1, the amplitude index A increases linearly from zero to one. During the steady-state portion between n1 and n2, the amplitude index remains at one. Finally, during the decay, the amplitude index decreases linearly from one to zero. The effect of the amplitude index A on the wave form X defined by Eq. (8) is now considered. At time n0, the amplitude of the musical tone defined by wave form X is zero. As time elapses, amplitude linearly increases until it reaches its maximum level at time n1. The amplitude of the tone remains constant during the steady-state portion until n2 and then linearly decreases until it reaches zero at n3.

Figure 14:
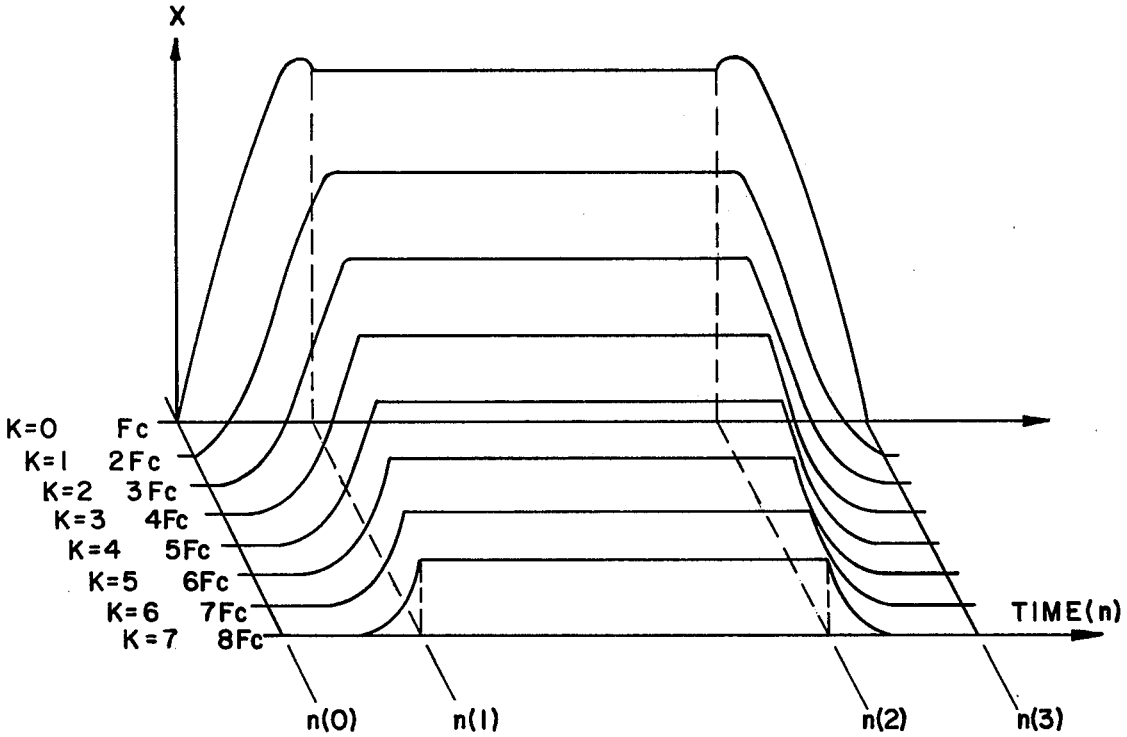
FIG. 14 depicts a wave form representative of the eight harmonics of a brass-like tone formed using the spectral index of FIG. 12 and the amplitude index of FIG. 13.

In FIG. 14, the combined effects of the spectral index I of FIG. 12 and the amplitude index A of FIG. 13 are depicted for the first eight harmonics of the wave form X of Eq. (8) or Eq. (9).

FIG. 14 for purposes of simplicity, separates each of the harmonics [k equal to zero through seven in EQ. (8)] on separate, parallel time axes. At time n0, the fundamental sinusoid having frequency Fc (and all harmonics) has a zero X axis amplitude because of the zero value of the amplitude index A of FIG. 13. As n increases in time from n0 to n1, the amplitude of the Fc component rapidly increases to its maximum value. The rate of increase of each of the progressively higher harmonics (for k equal one through seven) is progressively slower although each of the harmonics 2Fc through 8Fc reaches its own peak amplitude at time n1. Each of the progressively higher harmonics has a lower peak amplitude at time n1.

While only eight harmonics are shown in FIG. 14, it is apparent from Eq. (8) that the actual number of harmonics is infinite.

While Eq. (8) was utilized as a basis for producing brass-like tones, the selection of different values for the control parameters produces other tones. By setting Fm equal to two times Fc, only the odd harmonics are produced in Eq. (8). Such a relationship is useful for producing clarinet-like tones. If Fc is set equal to five times Fm, the spectrum produces a maximum on the fifth harmonic and is useful for producing bassoon-like tones. If Fc and Fm are related by an irrational number, Eq. (8) produces a spectrum that is perfectly inharmonic and which is useful in producing drum-like tones.

While Eq. (8) and Eq. (9) were derived from Eq. (1), each of the other Eqs. (2) through (7) are similarly suitable for use in forming musical spectra.

A digital music instrument, designed in accordance with Eq. (1) and Eq. (9), performs a non-linear transformation of a first function by a second function. The first function is a sine function of the type which appears in the numerator of Eq. (1) and Eq. (9) and the second function is of the form 1/z where z is equal to the denominator of Eq. (1) or Eq. (9). The digital circuitry includes a first memory (e.g. read-only memory) for storing values of the first function and a second memory (e.g. read-only memory) for storing values of the 1/z transformation function. Implementation of a music instrument in accordance with Eq. (1) requires, therefore, at least first and second function memories.

In a similar manner, Eq. (2) above is implemented employing four function memories. Eq. (2) employs the same type of function memories as employed in Eq. (1) and additionally employs a logarithmic function memory and a power of e function memory where the additional memories are employed to evaluate the factor $a^N$ which, after substitution of I, is $I^N$.

Eq. (3) employs the same type of function memories as Eq. (2). Eq. (4) employs the same type of function memories as Eq. (1). Eq. (5) employs a sine function memory like that utilized for the numerator of Eq. (1) and employs a second function memory for values which are powers of e. Eqs. (6) and (7) employ the same function memories as Eq. (5).

Eq. (7*b*) is an example of a polynomial transformation which, in this particular example is the well-known fifth Chebychev polynomial, C5 (a sin). Eq. (7*b*) employs a sine table of the Memory I type and a table of polynomials.

Simulating Specific Musical Instruments

As examples of different musical instruments, specific values for the controlling parameters Fc, Fm, N, A and I are given for six different tones that represent the major tonal groups of the orchestra. There are, of course, many other tones that could be made with these techniques, but these six are given as representative samples of tone qualities.

The six tones include three harmonic tones and three inharmonic tones. The six tones are brass-like, clarinet-like, double-reed-like, drum-like, bell-like, and wood-block-like. Of course, endless combinations can be made by adding these tones together. For instance, an inharmonic sound with a sudden attack and immediate decay can be combined with a harmonic sound to produce a "coarse" or "gritty" sounding attack on what might ordinarily be a harmonic tone.

In order to define tones, an ordered pair notation is employed. All the functions are piecewise-linear, so that only the break points need be represented. For instance, for spectral index functions shown in FIG. 12, notation is as follows: (0,0) (30,0.82) (250,0.82) (300,0).

That notation is read as a sequence of four ordered pairs which indicate four break points which define three line segments. Each break point appears with parenthesis where the first number of each pair is the time in milliseconds of the breakpoint, and the second number of each pair is the amplitude value attained at that point. The breakpoints are connected by straight lines (linear functions). Referring to FIG. 12, the first breakpoint (0,0) occurs at 0 time and 0 amplitude and is the point n0. The second breakpoint (30,0.82) occurs at 30 milliseconds, has an amplitude for I of 0.82, and is the point n1. Similarly, point n2 occurs at 250 milliseconds and point n3 at 300 milliseconds.

Although piecewise linear functions are adequate, more complicated functions may be used. For instance, tremelo can be provided in a signal by adding a sinusoidal component to the amplitude function, A.

Using the above ordered pair notation, the six tones are defined as follows:

Brass-Like Tone

I=(0,0) (30,0.82 (250,0.82) (300,0)
A=(0,0) (30,1.0) (250,1.0) (300,0)
Fc=Fm
N=8

These brass-like tone parameters are useful for all the Eqs. (1) through (7) except that the value of N only applies in the finite cases, Eqs. (2) and (3), and that the values of the index function, I, must be scaled to reach a maximum of 6 (rather than 0.82) for Eqs. (5), (6) and (7). If these differences are observed, all the equations produce somewhat similar sounds that are all distinctly brass-like.

This tone is actually quite short, being only 0.3 seconds in duration. We can produce tones of any length simply by extending the steady-state time between the inner two breakpoints of each function.

Clarinet-Like Tone

I=(0,0) (20,0.86) (250,0.86) (300,0)
A=(0,0) (20,1.0) (250,1.0) (300,0)
Fm=2Fc
N=8

For Eqs. (5), (6) and (7), the values of I should be scaled to reach a maximum of eight (rather than 0.86).

Double-Reed-Like Tone

I=(0,0) (20,0.75) (250,0.75) (300,0)
A=(0,0) (20,1.0) (250,1.0) (300,0)
Fc=5Fm (Fc=4Fm or 3Fm for higher notes)
N=8

This double-reed-like tone is not applicable to Eqs. (1) and (2) because it requires two-sided spectra. The most dominant double-reed cue is that the spectrum has a sharp maximum at some point in time with the harmonics descending in amplitude after that maximum. The timing of this maximum is determined by what multiple of Fm that Fc is set equal to. For the lower range (bassoon-like) a factor of 5 is in order. For the higher range (oboe-like), a factor of 3 is sufficient. For Eqs. (5), (6) and (7), the values of I should be scaled to reach a maximum of 5 (rather than 0.75).

Bell-Like Tone

I=(0.95,0) (500,0.50) (1500,0.25) (3000,0)
A=(1.0,0) (500,0.50) (1500,0.25) (3000,0)
Fm=1.41421356 Fc
N=9

The bell-like tone is not applicable to Eqs. (1) and (2) because it requires two-sided spectra. For Eqs. (5), (6) and (7), the values of I should be scaled to reach a maximum of sixteen (rather than 0.95). This tone is inharmonic, because Fc and Fm are related by an irrational number, which, in this case, is the square root of two, although many other irrational numbers work well. This tone starts out with a very high spectral index of 0.95, so that many partials are present. It dies out in a roughly exponential manner, ending up with a single sinusoid present. This behavior is similar to the actual behavior of natural bell tones.

Drum-Like Tone

I=(0.75,0) (50,0.35) (150,0.16) (350,0)
A=(0,0.8) (20,0.8) (40,1.0) (80,0.6) (120,0.3) (200,0.15) (350,0)
Fm=1.41421356 Fc
N=10

The drum-like tone is not applicable to Eqs. (1) and (2) because it requires two-sided spectra. For Eqs. (5), (6) and (7), the values of I should be scaled to reach a maximum of five (rather than 0.75). This tone starts immediately with a large spectral index to produce a sharp striking sound at the beginning.

Wood-Drum-Like Tone

I=(0.99,0) (50,0) (350,0)
A=(0,0.8) (20,0.8) (40,1.0) (80,0.6) (120,0.3) (200,0.15) (350,0)
Fm=1.41421356 Fc
N=10

The wood-drum-like tone is not applicable to Eqs. (1) and (2) because it requires two-sided spectra. For Eqs. (5), (6) and (7), the values of I should be scaled to reach a maximum of twenty (rather than 0.99). This tone starts immediately with a large spectral index to produce a sharp striking sound at the beginning, but decays almost immediately to a pure sinusoid, thus simulating a percussive attack followed by a pure tone.

While the above examples represent some of the sounds that are possible, many more sounds can be made by simple combinations of these basic formulae.

The amplitude or energy of the different tones must be normalized for uniformity. A simple way to normalize is to include a normalizing function or part of the amplitude function, A. In that way, only one function, A, must be carried along.

A further refinement that can be made is to add a constant phase offset. Replacing $\theta$ with $\theta+\phi$ allows another degree of freedom. The phase angle $\phi$ only has an effect on harmonic tones with significant amounts of harmonic negative frequency components which wrap around zero frequency to cancel or reinforce the positive frequency components. Adjustment of $\phi$ can cause the reflected components to add (constructively interfere) or subtract (destructively interfere).

Musical Instrument—FIG. 1

In FIG. 1, one digital electronic embodiment of a musical instrument in accordance with the present invention is shown. The musical instrument has a keyboard 3 which includes, for example, 64 keys. The keys, like those of a piano or organ, represent various musical tones or instruments. Actuation of the keys is detected and encoded, in a conventional manner to produce data which appears on the output buses 17, 18, 19 and 20. The 1-bit KEY bus 17 is connected to the control unit 4 for signaling the start, duration and ending of a note to be played by the musical instrument.

The 4-bit FREQ bus 18 designates the frequency or frequencies of notes to be played. Bus 18 connects to an amplitude control unit 5, a spectral control unit 6 and the initial data memory 7.

The 4-bit INSTR bus 19 designates one or more instruments (such as brass or drum) and the bus 19 connects to the amplitude control unit 5, the spectral control unit 6 and the initial data memory 7.

The 3-bit OCT bus 20 designates the octave of the notes played and bus 20 connects to the amplitude control unit 5 in the spectral control unit 6.

The initial data memory 7 is a memory for storing initial parameters which are employed in the method of the present invention. Those parameters include the sequence number (S), the center frequency (Fc), the modifying frequency (Fm), and the number of sidebands, (N), where that number is relevant. The initial data memory 7 is described in more detail in connection with FIG. 5.

The amplitude control unit 5 includes a read only memory for storing the amplitude index A. The unit 5 is addressed by the 4-bit INSTR number and the 3-bit OCT number from the keyboard 3. When addressed and internally sequenced, the amplitude control unit 5 outputs an amplitude index A to the write data bus (WDB) 22. The amplitude index is a function of the general type previously described in connection with FIG. 13. Control unit 5 is described in further detail in connection with FIG. 4.

The spectral control unit 6 is substantially identical in structure to the amplitude control unit 5, but stores the spectral control index, I. When addressed and internally sequenced, unit 6 provides the index I to the WDB bus 22. The spectral index I is a function of the same general type previously described in connection with FIG. 12. The details of control unit 6 are shown and described in connection with FIG. 4.

The write data bus (WDB) 22 connects as an input to the scratch pad memory 8. Scratch pad memory 8 is a conventional read/write memory having a capacity for 32 16-bit words. Memory 8 is addressed by the 8-bit scratch pad address bus (SPA) which connects from the control unit 4. To write information, scratch pad memory 8 receives data from the write data bus (WDB) 22. To read information, memory 8 provides data to the read data bus (RDB) 23.

The RDB bus 23 connects from memory 8 as an input to the multiplier 9, the adder 10, a first function memory 11, one or more second function memories 12, and the digital-to-analog converter 13.

The multiplier 9 is a conventional multiplier and includes control circuitry useful in the present invention. Multiplier 9 is shown and described in further detail in connection with FIG. 3. The output from multiplier 9 is on the 16-bit write data bus (WDB) 22.

Adder 10 is a conventional adder and associated circuitry for adding data supplied from the RDB bus 23 to form a sum on the WDB bus 22. Adder 10 is described in further detail in connection with FIG. 2.

A first function memory 11 (MEM 1) includes a read only memory for storing values of a first function (for example, a sine table) for use in accordance with the non-linear method of the present invention. Memory 11 is addressed by 11 bits from the RDB bus 23. The 16-bit output from memory 11 connects to the WDB bus 22.

One or more second function memories, 12-1, . . . , 12 - x, (MEM2) stores values of one or more second functions utilized in accordance with the present invention in forming a non-linear transformation of the first function. The memories 12, for example, are each addressed by 11 bits from the RDB bus 23 and each provide a 5-bit and a 16-bit output to the RDB bus 22. A second function of the type stored in the second function memories 12 is 1/z where z is typically the denominator of Eq. (9). Further details of the first and second memories 11 and 12 are shown and described in connection with FIG. 2.

The digital-to-analog converter (D/A CONV) 13 is a conventional device for receiving a number from the RDB bus 23 and for providing an analog output to a conventional sample and hold circuit 14. The sample and hold circuit in turn samples the analog output from converter 13 to provide an analog drive signal to the audio output 15. The latching of a number into the converter 13 is under the control of the DAC signal from control unit 4. Similarly, the sampling of the sample and hold circuit 14 is under control of an S/H signal from control unit 4.

Various control signals associated with the FIG. 1 apparatus are derived from and supplied to the control unit 4. Control unit 4 includes a sequencer which, in a preferred embodiment, operates under a control program to control the FIG. 1 apparatus on a real-time basis. Further details of the control unit 4 are described hereafter in connection with FIG. 6.

Figure 2:
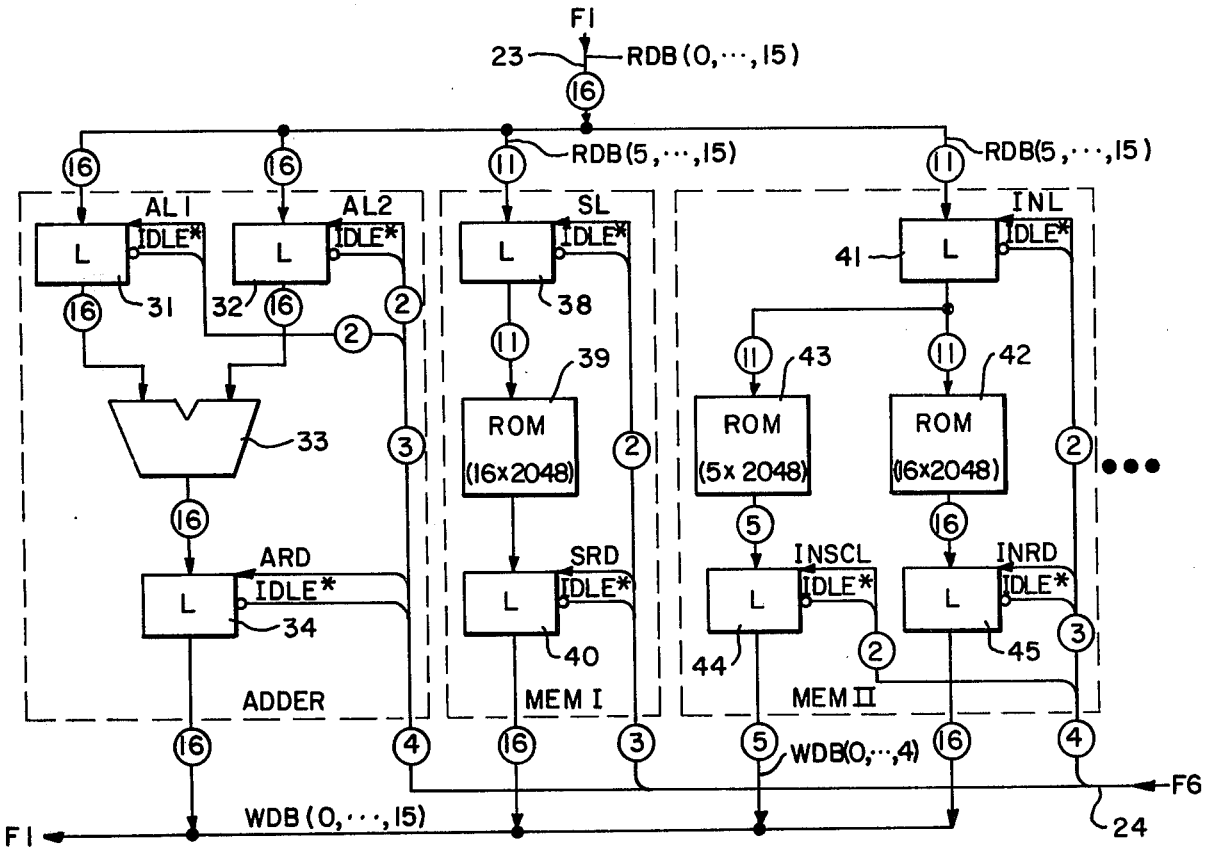
FIG. 2 depicts a schematic electrical block diagram of the adder and of the first and second function memories which form a portion of the musical instrument of FIG. 1.

Adder and Function Tables—FIG. 2

In FIG. 2, further details of the adder 10, the first function memory 11 and the second function memories 12 are shown.

The adder 10 includes a conventional 16-bit binary adder 33. One input to the adder 33 is from a conventional 16-bit latch 31 and the other input is from a conventional 16-bit latch 32. Latch 31 stores data from the RDB bus 23 on receipt of an AL1 signal and latch 32 stores data from the RDB bus 23 on receipt of an AL2 signal. The 16-bit output from binary adder 33 is latched into a conventional 16-bit latch 34 by the ARD signal. Each of the latches 31, 32 and 34 is cleared by the IDLE* signal. The AL1, AL2, ARD and IDLE* signals are derived from the control unit 4 of FIG. 6. The 16-bit output from latch 34 is connected to the WDB bus 22.

In FIG. 2, the first function memory 11 (MEM 1) includes a conventional read only memory (ROM)39. Memory 39 stores in a typical example 2,048 16-bit words. Memory 39 is addressed by 11 bits from the 11-bit conventional latch 38. An address is stored in latch 38 under control of the latch signal SL. The SL signal stores the high order 11 bits, RDB (5, . . . , 15) from the 16-bit RDB bus 23 which includes bits RDB (0, . . . , 15). The location in memory 39 addressed by the contents of latch 38 is stored in the 16-bit conventional latch 40 under control of the SRD latch signal. The data stored in latch 40 appears on the WDB bus 22. The latches 38 and 40 are cleared by the IDLE* signal. The signals SL, SRD and IDLE* are derived from the control unit 4 of FIG. 6.

In FIG. 2, a typical one of the second function memories, 12-1, includes a first read only memory (ROM) 42 and a second read only memory (ROM) 43. Memory 42 typically includes 2,048 16-bit words and memory 43 typically includes 2,048 5-bit words. Memory 42 is addressed by 11 bits from the conventional 11-bit latch 41. Latch 41 stores the high-order 11 bits, RDB (5, . . . , 15) from the RDB bus 23 under control of the latch signal INL and is cleared by the IDLE* signal.

In FIG. 2, the output from the memory 42 is latched into the 16-bit conventional latch 45 under control of the INRD latch signal. Latch 45 is cleared by the IDLE* signal. Data from latch 45 appears on the WDB bus 22.

Memory 43 is addressed by 11 bits from latch 41 and stores its output in the conventional 5-bit latch 44 under control of the INSCL signal. Latch 44 is cleared by the IDLE* signal. The 5 bits from latch 44 appear on the low-order 5 bits, WDB (0, . . . , 4), of the bus 22. While only one second function memory is shown in FIG. 2, additional function memories of any number "x" may be connected as shown in FIG. 1 for memories 12-1, . . . , 12-x. In one embodiment hereinafter described in connection with Eq. (2), the number of second memories is equal to three, that is, "x" equals three. The first one of the second memories is an inverse table 12-1.

A second one of the memories is an exponential table 12-2. For that table, the input latch 41 is latched by the signal EXL latch signal (equivalent to the signal INL). The latch signal for the output latch 45 is EXRD (equivalent to the latch signal INRD). The latch signal for the output latch 44 is EXSCL (equivalent to the latch signal INSCL).

The third one of the second memories utilized in connection with Eq. (2) is a logarithmic table 12-3. The latch signal for the input latch 41 is LL (corresponding to the INL). The latch signal for the output latch 45 is LRD (corresponding to INRD). In the case of the log memory, the second memory 43 and the second output latch 44 are not utilized.

The contents of the first and second function memories 11 and 12 will be described in more detail hereinafter. By way of example, the ROM 39 in the first function memory 11 typically stores a sinusoidal wave table. The contents of the second function memory 12 in one example is the inverse of the sum of a number plus a cosine function such as appears as the denominator of Eq. (1). The non-linear transformation is the product of a sine function from the first function memory 11 and the reciprocal of a number which includes a cosine function from the second function memory.

Figure 3:
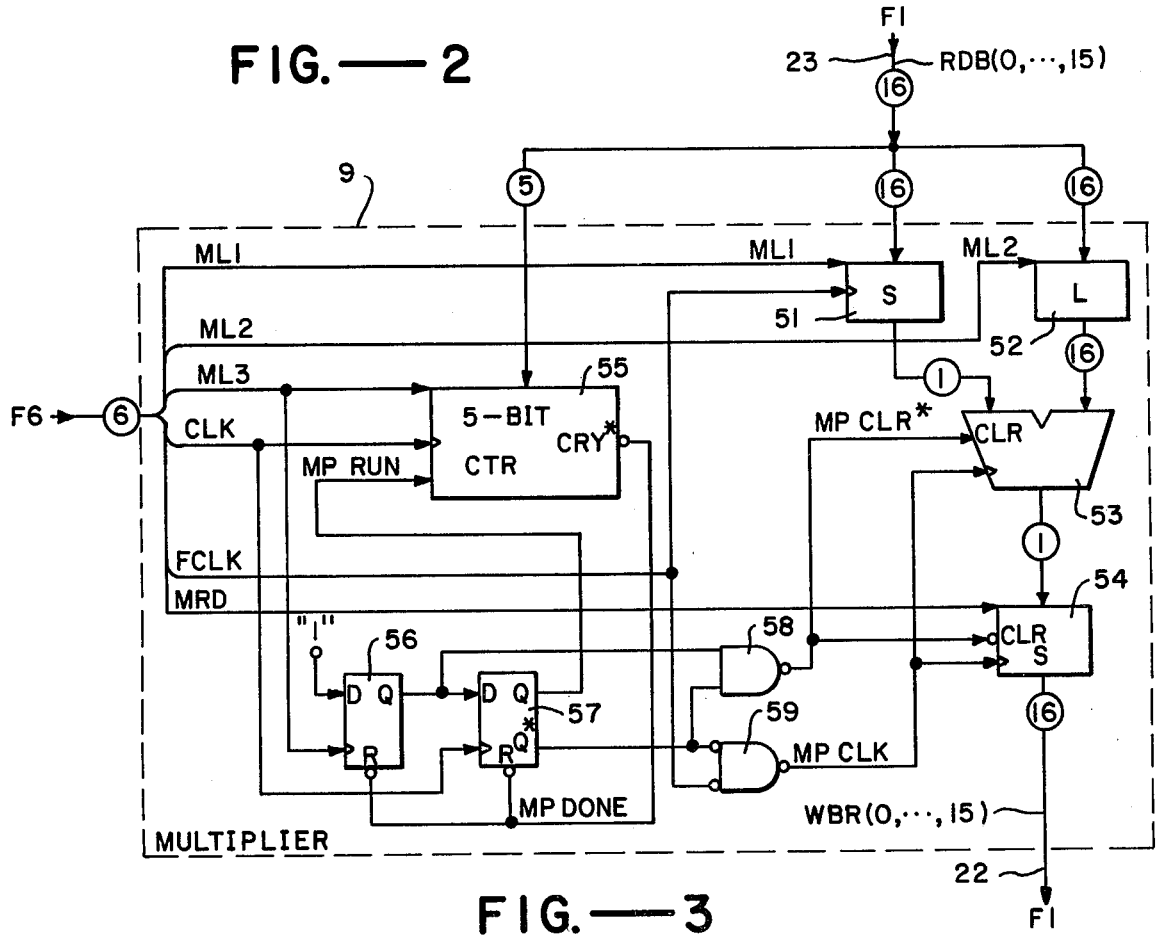
FIG. 3 depicts a schematic electrical block diagram of the multiplier which forms a portion of the musical instrument of FIG. 1.

Multiplier—FIG. 3

In FIG. 3, further details of the multiplier 9 in FIG. 1 are shown. The multiplier receives the 16-bit data from the RDB bus 23. The 16-bits of data from bus 23 are latched in the multiplier store 51 under the command of an ML1 latch signal. The contents of the bus output from latch 52 as a parallel input to the multiplier 53. Multiplier 53 also receives a serial 1-bit input from the store 51. The 16 bits loaded into store 51 are serially stepped into the multiplier 53 under control of the FCLK fast clock signal. Multiplier 53 performs a 16 by 16 bit multiply one bit at a time and correspondingly provides up to 32 bits, 1-bit at a time to the output store 54. The store 54 is clocked to receive the output from multiplier 53 by the MPCLK multiplier clock signal from the OR gate 59. The multiplier 53 is also clocked by the same MPCLK signal. Both the multiplier 53 and the store 54 are cleared by operation of the multiplier clear signal MPCLR* from the NAND gate 58. The store 54 operates either in the serial input mode to receive the serial output from the multiplier 53 or in the parallel output mode under control of the MRD signal. In response to the MRD signal, the store 54 provides a parallel 16-bit output to the WRB bus 22.

Multiplier 53 is a conventional two's complement multiplier available as a commercial product. Operation of the multiplier 53 is controlled by the clear signal MPCLR* from the NAND gate 58 and the clock signal MPCLK from the OR gate 59. The gates 58 and 59 are in turn controlled by the conventional D-type flip-flops 56 and 57 and a 5-bit binary counter 55.

In order to control the operation of the multiplier 53, the counter 55 is loaded with the low-order bits, RDB (0, . . . , 4) from the RDB bus 23. The 5 bits are loaded into counter 55 by the ML3 latch signal. The latching of data into the counter 55 by the ML3 latch signal also clocks the flip-flop 56 to store a 1. At the same time the data is stored into counter 55, the inverted carry output CRY* goes to a 1 removing the reset inputs from the flip-flops 56 and 57. The 1 which appears on the Q output of flip-flop 56 together with the 1 which appears on the Q* output of flip-flop 57 satisifies NAND gate 58 to produce a 0 for the MPCLR* signal. That 0 clears both the multiplier 53 and the output store 54. The next CLK clock signal causes the 1 from flip-flop 56 to be transferred to the flip-flop 57 causing the latter's Q output to go to a 1. That 1 enables counter 55 via the MPRUN line to start counting CLK clock pulses. At the same time, the Q* output of flip-flop 57 goes to 0 inhibiting the NAND gate 58 and enabling the OR gate 59. The gate 59 then is enabled to pass the FCLK fast clock signal which in turn becomes the MPCLK signal. Multiplier 53 multiplies as long as the MPCLK signal is present. The MPCLK signal continues clocking until the counter 55 has counted through its entire count and produces a 0 on the CRY* carry out line. The 0 CRY* signal is the MPDONE signal which resets both the flip-flops 56 and 57. The reset of flip-flop 57 causes its Q* output to go to a 1 thereby inhibiting further operation of gate 59 and enabling gate 58. Gate 58, however, will not provide a clear signal to the multiplier 53 or the shift register 54 until a new ML3 signal causes a new count to be latched into the counter 55.

The multiplier of FIG. 3 executes a number of steps determined by the count in counter 55. The purpose of controlling the number of steps results from the nature of two's complement multiplication. When two 16-bit two's complement numbers are multiplied together, a 32-bit product is obtained. Since the two high-order bits are identical, the highest-order one of them is discarded with no loss of information and utilized for sign information. Because the WDB bus is only 16 bits wide, a selection must be made as to which 16 bits of the 31-bit product are to be output on the WRB bus 22. If two integers are to be multiplied together, a scale factor stored in counter 55 specifies 16 steps so that the low-order 16 bits of the product will be selected. If the two numbers in stores 51 and 52 are fractional numbers, that is numbers less than 1 (such as values of a sine function), then all 31 steps must be employed in order to obtain the high-order bits of the product. In accordance with the present invention, a scaling process may be employed when an inverse table or an exponential table is employed as one of the functions. An inverse number can span a large range, one much larger than can be contained easily within 16 bits. For this reason, the multiplier of FIG. 3 employs a floating point scheme where the inverse of the number is represented as a 16-bit mantissa and a scale factor. The scale factor is the number that is stored into the counter 55 when the inverse function is used to form a product. In this manner binary scaling is accomplished by the multiplier 9.

Figure 4:
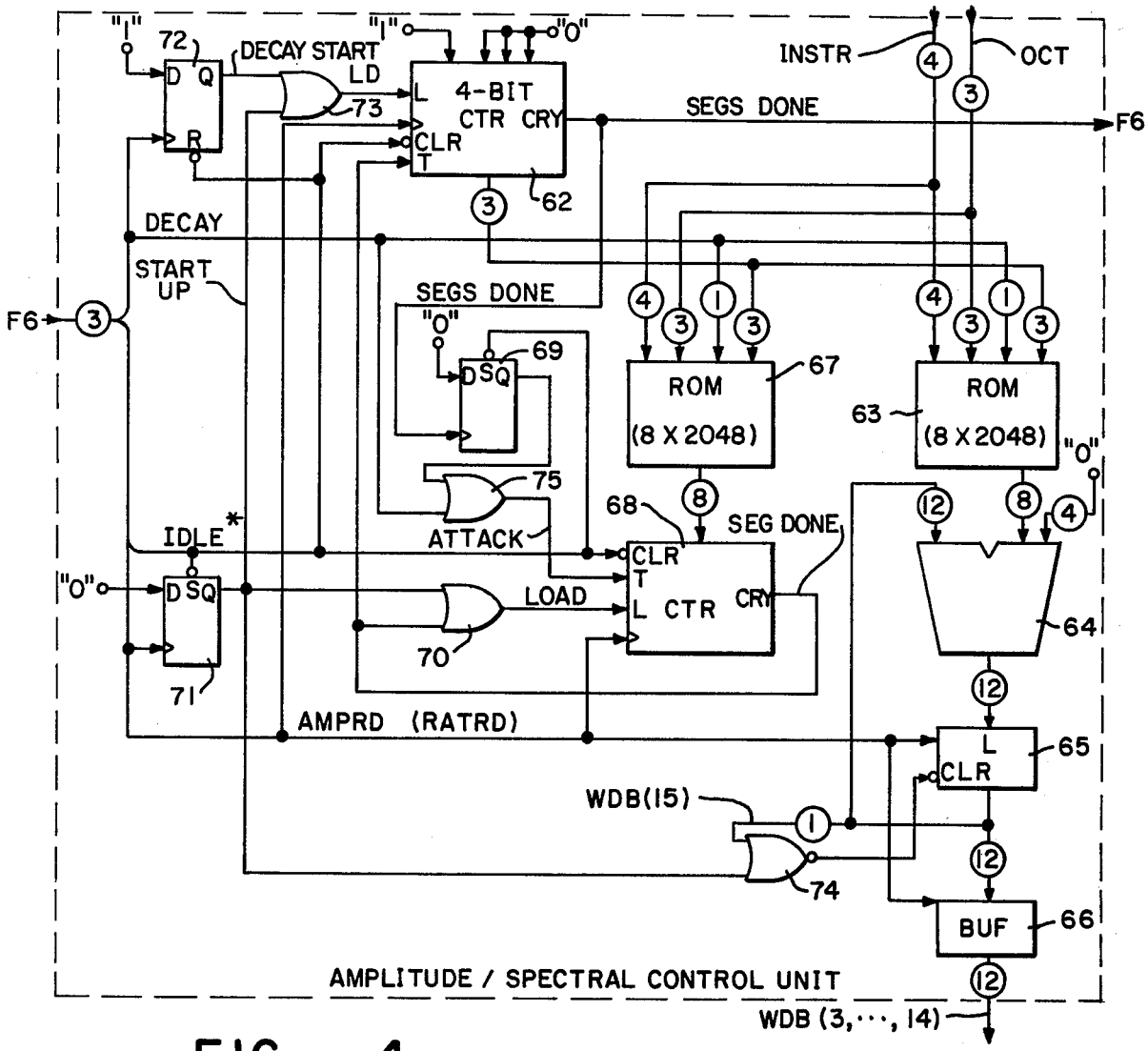
FIG. 4 depicts a schematic electrical block diagram of the amplitude control unit (and of the spectral control unit) which forms a portion of the musical instrument of FIG. 1.

Amplitude Control Unit—FIG. 4

In FIG. 4, the amplitude control unit 5 of FIG. 1 is shown in further detail. The spectral control unit 6 of FIG. 1 is also represented by the FIG. 4 apparatus.

In FIG. 4, the amplitude index A (or spectral index I) is stored as a piece-wise linear function. Eight segments are used to define the attack portion of the index and eight segments are used to define the decay portion of the index. Each segment consists of a count and an increment. The count determines duration and the increment determines the slope of the index. For each sample, an increment is obtained from read only memory (ROM) 63. Memory 63 is typically a 2,048 8-bit word store. The contents of memory 63 are addressed by the 4-bit instrument number (INSTR), the 3-bit octave number (OCT), a 1-bit control line (DECAY) which signifies when the decay portion is operating, and a 3-bit segment number (SEG NO) which determines which of the eight segments of an index is being processed. The 3-bit segment number is derived from the 4-bit counter 62. The DECAY control line is derived from the control unit 4 of FIG. 6 and the instrument and octave numbers are derived from the keyboard 3 of FIG. 1. These same inputs also connect to the read only memory 67. Memory 67, typically contains 2,048 8-bit words for storing counts which determine the duration of each segment. When memory 67 is addressed, a count is read out and stored under control of the LOAD signal in the counter 68. The count in counter 68 determines the number of times that the increment from memory 63 is accumulated and added to itself during a segment.

The 8-bit increment output from memory 63 is input to high-order bits of one side of a conventional 12-bit binary adder 64. The four low-order bits are forced to 0's. The product output from adder 64 is stored in the conventional 12-bit latch 65 under control of the AMPRD latch signal from the control unit 4 of FIG. 6. The output from latch 65 serves as the input to the other side of adder 64. Latch 65 is cleared by operation of the START UP signal from the Q output of the D-type flip-flop 71 through NOR gate 74.

In FIG. 4, a conventional D-type flip-flop 69 is clocked by the SEGS DONE line which is the carry out from the segment counter 62. The D-type flip-flop 72 is also clocked by the DECAY line.

The operation of the amplitude control unit commences when the IDLE* control line is 0. That 0 causes flip-flops 69 and 71 to be set to provide 1's on their Q outputs and clears flip-flop 72, counter 62, and counter 68.

When IDLE* goes to 1, the high-order bit of counter 62 is loaded to 1 and the low-order bits are loaded to 0. The loading occurs since flip-flop 71 retains a 1 on its Q output which, through OR gate 73, enables the load input of counter 62. Flip-flop 69 is also cleared by a 0 on the IDLE* line. When the IDLE* line goes to 1 and the clear signals are removed, the counter 62 is parallel loaded by the 1 which appears on the Q output on flip-flop 71. Similarly, the counter 68 is parallel loaded with an output from memory 67 under control of the LOAD line from OR gate 70.

On occurrence of the first AMPRD latch signal after IDLE* goes to 1, the flip-flop 71 is clocked to provide a 0 on its Q output so that the parallel load inputs for counter 62 and 68 are removed. The counter 68 is incremented one count for each AMPRD signal received. Also, the AMPRD signal latches the output from adder 64 into the latch 65 and enables the output buffer 66 to provide an output on the WDB bus. At this time, the SEG DONE signal from counter 68 is 0, so that the counter 62 is not enabled to count the AMPRD clock signals. Therefore, adder 64 continues to add the increment from memory 63 to itself as accumulated for each count in the counter 68. When counter 68 provides a carry out signal to provide a 1 for SEG DONE, the counter 62 is enabled to count one count by the next AMPRD signal. The SEG DONE carry out signal, through OR gate 70, also causes a new count to be loaded into counter 68 from memory 67 thereby removing the SEG DONE signal. The change in the count of counter 62 provides a new address to memories 63 and 67. Therefore, a new count is loaded into counter 68 and a new increment is provided to adder 64. The adder continuously accumulates and adds the new increment to its previous total until the count in counter 68 is counted to provide a new carry out. In this fashion, each segment is a piece-wise linear function which has a duration determined by the count stored in counter 68. Each segment has a slope, that is, a rate of change, determined by the increment from memory 63.

After the eight segments have been fully processed during the attack portion of the wave form, the counter 62 produces a carry out on the SEGS DONE line to clock the flip-flop 69.

The 0 on the Q output of flip-flop 69, through OR gate 75, inhibits the counter 68 from further counting until the DECAY signal goes to 1 which, through OR gate 75, again enables counter 68.

The 0 to 1 transition of the DECAY signal causes the flip-flop 72 to be clocked to store a 1. The 1 on the Q output of the flip-flop 72 is a DECAY START signal which, through OR gate 73, causes the high-order bit of counter 62 to be loaded with a 1 and the three low-order bits of counter 62 to be loaded with 0's since the SEG DONE line from counter 68 is still 1. Thus, the all 0's 3-bit output from counter 62 together with the 1 on the DECAY line provides a new address for the memories 63 and 67. That new address together with the instrument (INSTR) and octave (OCT) numbers determine the new count loaded into counter 68 and the new increment provided to the adder 64.

These new values initiate the decay portion of the wave form. The decay portion continues through all eight segment counts of counter 62. Each one of those segments has a duration determined by the respective counts loaded into counter 68 and each one has a slope determined by the respective increments output from memory 63.

Note that the decay portion starts with a value in latch 65 which was the steady-state value and which remained as the last value calculated during the attack portion. For decreasing decay, negative numbers are accessed from memory 63 and are added to the value in latch 65 to decrease that value. After the eight segments of the decay portion have been processed, counter 62 provides the SEGS DONE signal which connects to the control unit of FIG. 6. The control unit of FIG. 6 responsively generates the IDLE* signal as a 0 thereby clearing the control unit of FIG. 4 to its initial state. Thereafter, the FIG. 4 unit is available to process index numbers when IDLE* again goes to 1.

The operation of the spectral control unit 6 of FIG. 1 is substantially identical to the operation of the amplitude control unit 5 previously described in connection with FIG. 4 above. The one difference is that the AMPRD line for the amplitude control unit 5 is replaced by the RATRD line for the control unit 6. The contents, of course, of the memories 63 and 67 are different as will hereinafter be described.

Figure 5:
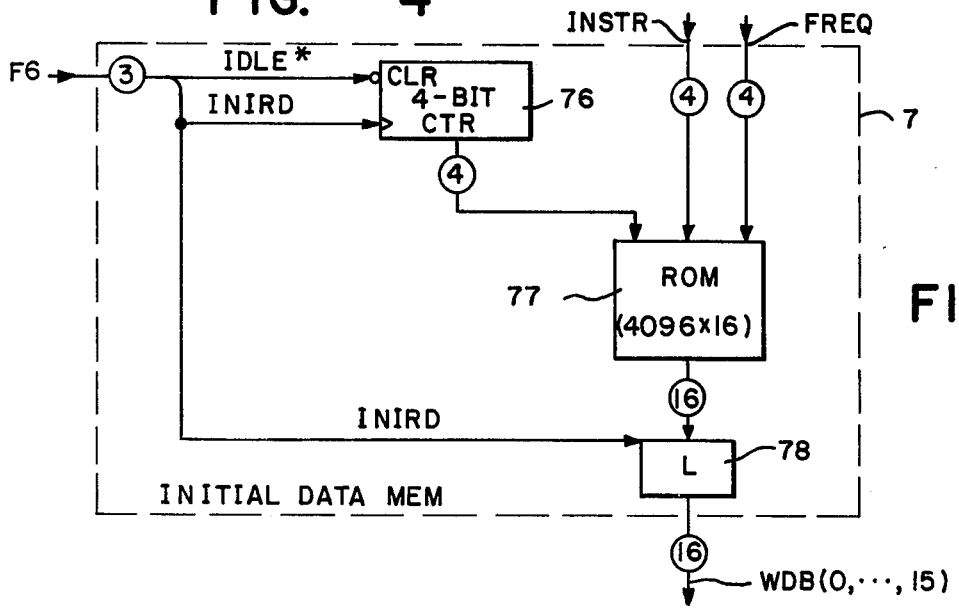
FIG. 5 depicts a schematic electrical block diagram of the initial data memory which forms a portion of the musical instrument of FIG. 1.

Initial Data Memory—FIG. 5

In FIG. 5, the initial data memory 7 stores the initial parameters which are necessary to commence operation of the present invention. One parameter is the sequence number (S) which specifies one of a number of different sequences each derived from a different one of the Eqs. (1) through (7) above. The memory also stores the center frequency, Fc, the modifying frequency Fm, and the number, N, of sidebands where relevant. Each of these parameters is determined by the frequency number (FREQ) and the instrument number (INSTR) which is specified by the keyboard. In addition to S, Fc, Fm, and N up to four other parameters (such as $\phi$, a constant phase angle offset) may be stored in the particular embodiment of FIG. 5. The parameters are stored in read only memory (ROM) 77 which stores up to 4,096 16-bit words. The parameters are read out from memory 77 and latched into the latch 78 under control of the INIRD latch signal. The parameters are read out one at a time under control of the 3-bit counter 76. Counter 76 is cleared to 0 by the IDLE* signal from the control unit of FIG. 6 and thereafter is clocked for each INIRD signal. Accordingly, four successive INIRD signals will load the four parameters S, Fc, Fm, and N onto the WDB bus one at a time for initial processing and storage in the scratch pad memory 8 of FIG. 1. The remaining counts from counter 76 are optionally employed for use with additional parameters if any.

Figure 6:
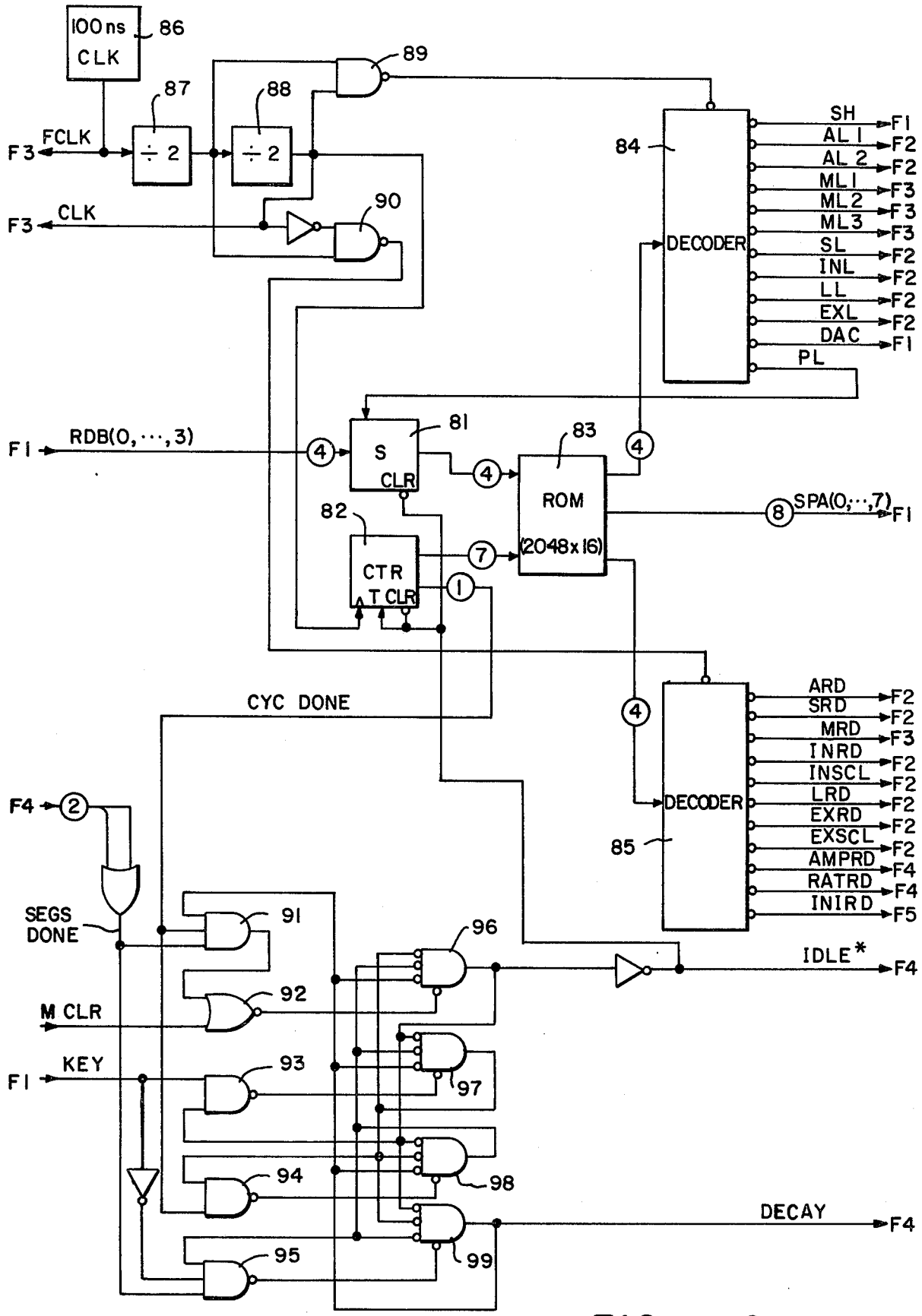
FIG. 6 depicts a schematic electrical block diagram of the control unit which forms a portion of the musical instrument of FIG. 1.

Control Unit—FIG. 6

In FIG. 6, the control unit 4 is timed by a 100 nanosecond clock 86. The output from clock 86 is the fast clock signal FCLK. The output from clock 86 is counted down by divide-by-2 counter 87 and thereafter by subsequent divide-by-2 counter 88. The output from counter 88 is the main clock signal CLK which operates at 400 nanoseconds. Each clock signal, via NAND gate 89 causes a decoder 84 to be enabled and via NAND gate 90 causes decoder 85 to be enabled. Decoders 84 and 85 each receive a different 4-bit output from a read only memory (ROM) 83. In one embodiment, the memory 83 includes 2,048 16-bit words. In addition to the two 4-bit decoder memory 83 also provides an 8-bit output which specifies the scratch pad memory address SPA (0, . . . , 8). Memory 83 is addressed by the 4-bit output from a first store 81 and the 7-bit output from a counter 82. Store 1 stores the sequence number S and is parallel loaded by the 4-low order bits of the RDB bus, namely RDB (0, . . . , 3) by a PL signal from decoder 84. The sequence number is derived from the initial data memory 7. The IDLE* signal initially clears store 81 so that the first sequence number is always all 0's. The all 0's sequence is an initialize sequence which performs initial calculations for storage in the scratch pad memory.

The 7-bit address from the counter 82 starts at an initial all 0's value and is thereafter counted in order through all addresses in the sequence and also the unused addresses by operation of the CLK signal. The high-order bit of counter 82 is the CYC DONE line, which indicates that a sequence is completed and that counter 82 has counted through to the high-order count. The CYC DONE line is an input to the AND gate 91 and the NAND gate 94. Gates 91 through 94 provide the control logic for determining the various states of the music instrument of FIG. 1. Those gates establish one out of four states at any one time. The four states are IDLE, INIT, RUN, DECAY as represented by a 1 output from gates 96 through 99, respectively. The activation of any one state inhibits the activation of any of the other states.

Under normal operation, after a sufficient amount of time, the CYC DONE signal from counter 82 in FIG. 6, the two OR'ed SEGS DONE signals (one each from the amplitude and spectral control units 5 and 6 of FIG. 1) and the DECAY signal from FIG. 6 will enable the AND gate 91 to produce a 1 as an input to NOR gate 92. Alternatively, the MCLR master clear signal (generated, for example, from a conventional power on circuit which is not shown) will produce a 1 to NOR gate 92. Any 1 to gate 92 forces its output to a 0 which forces the output of NOR gate 96 to 1.

If none of the other gates are being forced to 1, then gate 96 remains a 1 when the forcing input from gate 92 is removed. A 1 from gate 96 inhibits any of the other gates 97, 98 or 99 from being enabled to produce a 1 output. The 1 output from gate 96 is inverted to form the IDLE* signal, which is a 0 during the idle state. A 0 for the IDLE* signal clears, sets, or resets the stores throughout the music instrument of FIG. 1 as previously described. The output from gate 96 remains a 1 since each of the other outputs from gates 97, 98 and 99 have 0's on their outputs. The AND gate 91 returns to a 0 because the 0 IDLE* signal clears counter 82 causing the CYC DONE signal to go to zero.

Gate 96 remains with a 1 on its output until gate 97 is forced to 1 by operation of NAND gate 93. Gate 93 is satisfied by the 1 output from gate 96 and a 1 on the KEY signal. The KEY signal is a 1 whenever one of the keys of keyboard 3 is depressed to signal the music instrument to initiate a musical tone. When the output of gate 97 is forced to a 1 by gate 93, the IDLE* signal is switched from a 0 to a 1. With the IDLE* signal a 1, the clear signals from store 81 and counter 82 are removed leaving both initially all 0's. The all 0's contents of store 81 specifies an initialization sequence in memory 83. That initialization sequence is operative to perform certain preliminary calculations and load locations in the scratch pad memory 8 of FIG. 1. Each of the steps in the initialization sequence is accessed in order by the operation of counter 82 which is stepped through the addresses in the initialization sequence by the CLK signal. When the counter 82 has completed all the steps in the initialization sequence, the counting continues until high-order count is reached to provide a 1 on the CYC DONE line which, together with the 1 from gate 97, satisfies NAND gate 94. With gate 94 satisfied, a 0 output forces gate 98 to have a 1 output which in turn causes the output from gate 97 to go to 0. One of the last steps of the initialization sequence causes decoder 84 to select the program latch line PL which loads a non-zero sequence number from the RDB bus into counter 81. The musical instrument of FIG. 1 is now ready to perform one of up to sixteen sequences. By way of example, eight possible different sequences derived from Eq. (1) through Eq. (7b) above. With the new sequence number in store 81, counter 82 immediately commences execution of the steps of that sequence by providing counts which access the steps of the sequence from memory 83. The decoded outputs from memory 83 cause the decoders and scratch pad addresses to control the operation of the musical instrument in the desired manner.

Operation

The operation of the FIG. 1 musical instrument will be described in connection with one specific sequence of the type derived from Eq. (2). Eq. (2) is multiplied by the amplitude scale factor A and the value of "a" is substituted with the spectral index, I; $\theta$ is set to equal to $2\pi(Fc)nT$; and $\beta$ is set equal to $2\pi(Fm)nT$ all in the manner previously described in connection with Eqs. (1), (8), and (9).

A sequence which is derived from Eq. (2) is identified with a sequence number, S (for example, 2). That sequence number is uniquely specified by the FREQ and INSTR inputs to the initial data memory 7 of FIG. 1. Before the specified sequence 3 can actually be implemented, an initial sequence must be executed in order to initialize the scratch pad memory 8 of FIG. 1.

The initial sequence is specified by the initial all 0's contents of counter 81 in FIG. 6. For the initial sequence, the counter 82 in FIG. 6 steps through the counts to load the following locations in the scratch pad memory: A1, DA1, A2, DA2, A3, DA3, A4, DA4, A5, DA5, K31, K29, K16, K1 and N. In addition to those locations, the additional locations, T1, T2, T3, T4, and T5 are utilized in memory 8 as scratch pad storage. Although the locations in memory 8 have been given symbolic names, they are addressed in a conventional manner by an address output from the read only memory 82 in the control unit of FIG. 6. While the memory 82 has a capacity for addressing up to eight binary bits, the scratch pad memory 8 of FIG. 1 only requires five binary bits to address the thirty-two locations. In the particular example described, not all of those thirty-two locations are actually required.

The initialization sequence includes a number of steps, each represented by a different count of counter 82. A number of those steps command a decode of memory 83 to select the INIRD output from decoder 85.

Each time the initialization sequence causes the INIRD line to be energized, the counter 76 in FIG. 5 is stepped to a new count. Each count of counter 76 together with the INSTR number and the FREQ number address a different location in the read only memory 77 of FIG. 5. A first count of counter 76 causes the angular increment corresponding to the center frequency Fc to be gated to latch 78. After storage in latch 78, a subsequent count of counter 82 in FIG. 6 addresses memory 83 and stores the Fc contents of latch 78 in the DA1 location of the scratch pad memory 8.

A second count of counter 76 in FIG. 5 causes an angular increment corresponding to the frequency Fm to be latched into latch 78. A subsequent count of counter 82 in FIG. 6 causes the Fm contents of latch 78 to be stored in the DA5 location of the scratch pad memory.

A third count of the counter 76 in FIG. 5 causes the number of partials N to be latched into latch 78 and thereafter, counter 82 in FIG. 6 causes the number of partials to be stored in the location N of the scratch pad memory 8.

In a similar manner, subsequent counts of counter 76 cause constant numbers to be stored in the A5, K31, K29, K8 and K1 locations of the scratch pad memory 8.

After the initial locations of the scratch pad memory 8 have been filled from the initial data memory of FIG. 5, additional calculations are performed during the initial sequence to fill other locations in the scratch pad memory. Specifically, location DA2 is loaded with the angular increment corresponding to the frequency Fc-Fm which is the sum, calculated using adder 10, of the contents of the DA1 and DA5 locations (if DA5 is a negative number). In order to form negative numbers, a $-1$ is stored in one location of the initial data memory and is loaded into the T1 location of the scratch pad memory. Thereafter, multiplication by $-1$ converts any positive number to a negative number and specifically, $-$Fm.

The location DA3, using the contents of the DA1, DA5 and N locations, is loaded with the angular increment corresponding to the frequency [Fc+N(Fm)]. The DA4 location is loaded with the angular increment corresponding to the frequency Fc+(N−1)Fm. The 0.25 number stored in location A5 is converted to a negative number by $-1$ multiplication. In addition, each of the angular increment locations DA1 through DA5 must be scaled to the proper octave.

As a result of the initialization sequence, the locations in scratch pad memory have the following designations.

A1—Angle corresponding to $\theta=2\pi(\mathrm{Fc})\mathrm{nT}$

DA1—Angular increment corresponding to the center frequency, (Fc)

SA2—Angle corresponding to $(\theta-\beta)=2\pi[(\mathrm{Fc})-(\mathrm{Fm})]\mathrm{nT}$

DA2—Angular increment corresponding to the frequency (Fc)−(Fm)

A3—Angle corresponding to $(\theta+\mathrm{N}\beta)=2\pi[(\mathrm{Fc}+\mathrm{N}(\mathrm{Fm})]\mathrm{nT}$

DA3—Angular increment corresponding to the frequency [(Fc)+N(Fm)]

A4—Angle corresponding to $\theta+(\mathrm{N}-1)\beta=2\pi[(\mathrm{Fc})+(\mathrm{N}-1)(\mathrm{Fm})]\mathrm{nT}$

DA4—Angular increment corresponding to the frequency [(Fc)+(N−1)(Fm)]

A5—Angle corresponding to $(\beta+3\pi/2)=(2\pi(\mathrm{Fm})\mathrm{nT}+3\pi/2)$

DA5—Angular increment corresponding to the frequency (Fm)

N—Number of partials desired

T1, T2, T3, T4, T5—temporary cells

K31, K29, K16, K1—binary constants

As part of the initialization sequence, the values of A1, A2, A3, and A4 are all 0. The initial angle of A5 of $-0.25$ is equivalent to a shift of $3\pi/2$. Therefore, the initial value of $\beta+3\pi/2$ stored in A5 is $3\pi/2$ meaning that the initial value of $\beta$ in location A5 is 0. The purpose of adding $3\pi/2$ to A5 is to allow a sine table to be utilized in calculating the cosine function which appears in the denominator of Eq. (2).

After the above values have been loaded and calculated for the scratch pad memory, the last step of the initial sequence is to load a sequence number into the counter 81. That sequence number is derived from the initial data memory of FIG. 5. The initial data memory of FIG. 5 loads the sequence number into latch 78 by operation of INIRD signal output from decoder 85 of the control unit FIG. 6.

The sequence specified by the sequence number in store 81 is contained in the read only memory 83. An example of such a sequence is shown in the following TABLE I where locations in the scratch pad memory are denoted by parenthesis.

TABLE I

| | | | | | |
|---|---|---|---|---|---|
| S1 | (A1) | → | AL1 | | |
| S2 | (DA1) | → | AL2 | | |
| S3 | ADRD | → | (A1) | → | SL |
| S4 | (A2) | → | AL1 | | |
| S5 | (DA2) | → | AL2 | | |
| S6 | ADRD | → | (A2) | | |
| S7 | (A3) | → | AL1 | | |
| S8 | (DA3) | → | AL2 | | |
| S9 | ADRD | → | (A3) | | |
| S10 | SRD | → | (T1) | | |
| S11 | (A2) | → | SL | | |
| S12 | (A4) | → | AL1 | | |
| S13 | (DA4) | → | AL2 | | |
| S14 | ADRD | → | (A4) | | |
| S15 | (A5) | → | AL1 | | |
| S16 | (DA5) | → | AL2 | | |
| S17 | ADRD | → | (A5) | | |
| S18 | SRD | → | (T2) | → | ML1 |
| S19 | RATRD | → | (T2) | → | ML2 |
| S20 | (K29) | → | ML3 | | |
| S21 | (A3) | → | SL | | |
| S22 | (T2) | → | LL | | |
| S23 | NOP | | | | |
| S24 | NOP | | | | |
| S25 | NOP | | | | |
| S26 | NOP | | | | |
| S27 | NOP | | | | |
| S28 | SRD | → | (T5) | | |
| S29 | LRD | → | (T3) | | |
| S30 | MRD | → | (T4) | → | AL1 |
| S31 | (T3) | → | ML1 | | |
| S32 | (N) | → | ML2 | | |
| S33 | (K16) | → | ML3 | | |
| S34 | (T1) | → | AL2 | | |
| S35 | ADRD | → | (T1) | | |
| S36 | (A4) | → | SL | | |
| S37 | NOP | | | | |
| S38 | MRO | → | (T4) | → | EXL |
| S39 | NOP | | | | |
| S40 | NOP | | | | |
| S41 | (T2) | → | ML2 | | |
| S42 | SRD | → | (Tr) | → | ML1 |
| S43 | (K29) | → | ML3 | | |
| S44 | (A5) | → | SL | | |
| S45 | NOP | | | | |
| S46 | NOP | | | | |
| S47 | NOP | | | | |
| S48 | NOP | | | | |
| S49 | NOP | | | | |
| S50 | (T5) | → | AL1 | | |

TABLE I-continued

| | | | | | |
|---|---|---|---|---|---|
| S51 | SRD | → | (T5) | | |
| S52 | MRD | → | (T4) | → | AL2 |
| S53 | EXRD | → | (T4) | → | ML1 |
| S54 | ADRD | → | (T4) | → | ML2 |
| S55 | EXSCL | → | (T4) | → | ML3 |
| S56 | NOP | | | | |
| S57 | NOP | | | | |
| S58 | S/H | | | | |
| S59 | NOP | | | | |
| S60 | NOP | | | | |
| S61 | NOP | | | | |
| S62 | NOP | | | | |
| S63 | NOP | | | | |
| S64 | MRD | → | (T4) | → | AL1 |
| S65 | (T2) | → | ML1 | | |
| S66 | (T2) | → | ML2 | | |
| S67 | (K29) | → | ML3 | | |
| S68 | (T1) | → | AL2 | | |
| S69 | ADRD | → | (T1) | | |
| S70 | NOP | | | | |
| S71 | NOP | | | | |
| S72 | NOP | | | | |
| S73 | NOP | | | | |
| S74 | NOP | | | | |
| S75 | NOP | | | | |
| S76 | MRD | → | (T4) | → | AL1 |
| S77 | (T5) | → | ML1 | | |
| S78 | K29 | → | ML3 | | |
| S79 | (K1) | → | AL2 | | |
| S80 | ADRD | → | (T4) | → | AL1 |
| S81 | NOP | | | | |
| S82 | NOP | | | | |
| S83 | NOP | | | | |
| S84 | NOP | | | | |
| S85 | NOP | | | | |
| S86 | NOP | | | | |
| S87 | MRD | → | (T4) | → | AL2 |
| S88 | ADRD | → | (T4) | | INL |
| S89 | (T1) | → | ML1 | | |
| S90 | NOP | | | | |
| S91 | NOP | | | | |
| S92 | NOP | | | | |
| S93 | NOP | | | | |
| S94 | NOP | | | | |
| S95 | NOP | | | | |
| S96 | INRD | → | (T4) | → | ML2 |
| S97 | INSCL | → | (T4) | → | ML3 |
| S98 | NOP | | | | |
| S99 | NOP | | | | |
| S100 | NOP | | | | |
| S101 | NOP | | | | |
| S102 | NOP | | | | |
| S103 | NOP | | | | |
| S104 | NOP | | | | |
| S105 | MRD | → | (T4) | → | ML1 |
| S106 | AMPRD | → | (T4) | → | ML2 |
| S107 | (K31) | → | ML3 | | |
| S108 | NOP | | | | |
| S109 | NOP | | | | |
| S110 | NOP | | | | |
| S111 | NOP | | | | |
| S112 | NOP | | | | |
| S113 | NOP | | | | |
| S114 | NOP | | | | |
| S115 | NOP | | | | |
| S116 | MRD | → | (T4) | → | DAC |

The sequence of TABLE I includes 116 steps which correspond to 116 counts of the counter 82. The sequence of TABLE I is repeatedly executed, once for each sample which is transmitted in FIG. 1 from the sample and hold circuit 14 to the audio output device 15. Each of the steps of the sequence is executed at the rate of the CLK signal which is a 400 nanosecond signal. The total time to execute the sequence of TABLE I, therefore, is 116 times 400 nanoseconds or 0.464 times $10^{-4}$seconds. The maximum sampling frequency obtainable with the TABLE I sequence is accordingly 21.6 times $10^3$ Hz. Since counter 82 continues to a count of 128, however, the actual sampling frequency is 19.531 times $10^3$ Hz.

If Eq. (2) has the substitutions and multiplications of the same form as Eqs. (8) and (9) above and the terminology of the data in the scratch pad memory is employed, the musical instrument of FIG. 1 forms time dependent samples of the wave form X at a frequency of 19.531 times $10^3$ samples per second where X is defined by the following Eq. (10):

$$X = \frac{\sin(A1) + I\sin(A2) + I^N\{\sin(A3) + I\sin(A4)\}}{1 + I^2 + 2I\sin(A5)} \qquad \text{Eq. (10)}$$

The manner in which the sequence of TABLE I forms the samples X is now described in detail.

In TABLE I, there are a number of commands which cause data to be latched from the read data bus RDB (23). Those commands are AL1 and AL2 for controlling the adder 10 input latches; ML1 and ML2 for controlling the multiplier 9 input latches; ML3 for controlling the multiplier 10 scale factor latch; SL for controlling the sine table latch of the function memory 11; the INL command for controlling an inverse table latch (the function memory 12-1); the EXL command which is an exponential table latch (the function memory 12-2); an LL command which is a command for controlling the log table latch (the function memory 12-3); and the DAC command which controls the latch into the digital-to-analog converter 13.

Information to be latched and available on the write data bus (WDB) 22 includes a number of commands in TABLE I. Those commands are ADRD for reading the output of the adder 10; MRD for reading the output of multiplier 9; SRD for reading the output of the sine table (memory 11); INRD for reading the output from the inverse table (memory 12-1); INSCL for reading the scale factor of the inverse table (memory 12-1); the EXRD command for reading the output of the exponential table (memory 12-2); EXSCL for reading the scale factor of the exponential table (memory 12-2); LRD for reading the output from the logarithm table (memory 12-3); AMPRD for reading the amplitude index A from the amplitude control unit 5; RATRD for reading the ratio index I from the spectral control unit 6. The command INIRD for reading the next number from the initialization memory has already been described. The command S/H is generated in TABLE I in order to gate the contents of the D-to-A converter 13 to the sample and hold circuit 14. The S/H command occurs once per execution of the sequence of TABLE I and hence causes the sample and hold circuit to operate at the $19.531 \times 10^3$ Hz frequency.

Iteration of TABLE I Sequence

In S1, the scratch pad memory location A1 has its contents addressed and latched into the latch 31 by the AL1 signal.

In S2, the contents of scratch pad memory location DA1 are addressed and latched into the adder latch 32 by the AL2 signal. The adder 33 of FIG. 2 forms the sum of the contents of latches 31 and 32.

In S3, the results of the addition are stored in the latch 34 (by the ADRD signal), are stored in the A1 location of the scratch pad memory and are stored in the sine table latch 38 (by the SL signal).

In steps S4 through S6, the contents of the A2 and DA2 locations of the scratch pad memory are added and returned to the A2 location.

In steps S7 through S9, the contents of A3 and DA3 are added and returned to the A3 location.

In S10, the results of the sine table look up initiated in S3 are latched into the latch 40 of FIG. 2 and in the T1 location of the scratch pad memory. At this time the T1 location of the memory stores sin(A1).

In S11, the sine table look up of the sum determined in S6 is latched into the input of the sine table memory 11.

In S12 through S14 an addition of the type previously described in carried out and stores the result in the A4 location of the scratch pad memory.

In S15 through S17, another addition is performed in the manner previously described.

In S18, results of the sine look up initiated in S11 are input to the multiplier 9. The multiplier now has a value representing sin(A2).

In S19, a value of the spectral index I is accessed from the spectral control unit 6 and input to the scratch pad memory location T2 and to the other multiplying input of the multiplier 9.

In S20, the contents of location K29, equal to 29, is accessed from the scratch pad memory and is stored in the multiply control store 55 of FIG. 3 to specify a fractional multiply of 29 steps.

The multiplier 9 operates at four times the frequency of the CLK signal so that the multiply product is not available until after eight cycles of the CLK signal. The eighth clock cycle occurs during S28. The MRD command actually occurs at S30 and latches the multiply product into the store 54 of FIG. 3 and makes the product available on the WRD bus 22.

While the multiply operation is occuring between S20 and S30, other functions may be performed by the music instrument of FIG. 1.

In S21, the contents of A3 are sent to the sine table memory 11.

In S22, the spectral index value, I, stored in T2, is sent to the log table memory 12-3 so as to obtain the log(I).

In S23 through S27, no operation is performed as signified by the "NOP" designation. These "NOP" commands from S23 through S27 are utilized to allow the multiplier to finish its operation.

In S28, sin(A3) is stored in T5.

In S29, log(I) is stored in T3.

In S30, Isin(A2) is stored in T4.

In S31 through S33, a multiply of N times log(I) is initiated where the multiply includes eight steps and is an integer multiply.

Iteration of the TABLE I sequence continues in the same fashion of which the following are highlights of the operation.

In S35, the quantity sin(A1)+Isin(A2) is stored in A1.

In S38, the results of the multiply specified in S31 through S33 is available and is sent to the exponential table memory 12-2 in order to initiate raising "e" to the power N log(I).

In S41 through S43, a multiply of Isin(A4) is initiated. This multiply is a fractional multiply of 29 steps which requires eight CLK cycles.

In S52, the product of the multiply specified in S41 through S43 is available and is added to sin(A3).

In S53, the value of $I^N$ is obtained as the output from memory 12-2 as a result of the request intiated in S38.

In S53 through S55, a multiply of $I^N$ by sin(A3)+Isin(A4) is called for with a scale factor determined in S55 from the exponential memory 12-2.

In S58, a S/H is sent to the sample and hold circuit 14 to provide a sample of the output of the converter 13 to the audio output device 15 (see FIG. 1). If the first iteration of the TABLE I sequence is being performed, then the output from converter 13 is 0. If a second or subsequent iteration of the TABLE I sequence is being performed then the value sampled at S58 is the value determined by the previous iteration by the TABLE I sequence. The value determined in the previous iteration is latched in the converter 13 at S116 (that is at the final step of the previous iteration of the TABLE I sequence). The S/H command appears in the S58 location so as to be removed in time from the DAC signal (for example, more than 58 CLK clock pulses after DAC latches a value in the converter 13). In this way, comverter 13 has sufficient time to perform the digital-to-analog conversion to provide an analog output signal without any unwanted transients.

In S64, the results of the multiply specified in S53 through S55 is available.

In S69, the complete value of the numerator of Eq. (10) is stored in the T1 location of the scratch pad memory.

In S76, through S116, the remainder of the calculations for the denominator of Eq. (10) are performed.

In S76 through S78, the spectral index I is multiplied by sin(A5), scaled by a factor of two, to form the right hand term of the denominator of Eq. (10).

In S79 and S80, the quantity 1.0 is added to the quantity $I^2$ to form the sum of the two left hand terms of the denominator. The results of the addition are returned to the adder 10 for addition to the right hand term of the denominator when the multiplication is finished in S87. The complete denominator is available as the output from the adder in S88. The table look-up inverse of the denominator from memory 12-1 is initiated in S88 and becomes available for multiplication in S96 and S97. The multiplication of the numerator and the inverse denominator is initiated in S89, S96 and S97.

In S105 through S107, multiplication by the amplitude index A (obtained from the amplitude control unit 5) is initiated.

In S116, the results of the multiplication are available and the product is transmitted to the digital-to-analog converter 13 of FIG. 1.

At this time, the iteration of the TABLE I sequence is completed. In FIG. 6, the counter 82 stands at count 116 and continues counting up to count of 128. Thereafter, counter 128 starts counting again at the zero count and starts a new iteration of the TABLE I sequence. The iterations of the TABLE I sequence are continued until the complete wave form, that is, the musical sound, has been produced.

Example of TABLE I Sequence for Brass-Like Tones

In order to produce a brass-like tone, the values Fc and Fm are selected to be equal with a frequency of 440 Hz. The sampling rate of the TABLE I sequence is 19531.25 Hz which corresponds to a sampling period of 51.2 microseconds per sample. The number of harmonics, N, is selected to be 8. Using the notation explained in connection with FIGS. 12, 13 and 14, the amplitude index A is defined as (0,0) (30,1.0) (280,1.0) (330,0) and the spectral index I is selected to be (0,0) (30,0.82) (280,0.82) (330,0).

During the initialization sequence, the initial data memory 7 of FIG. 1 provides the following constant numbers, N equal to 8; K31 equal to 31; K29 equal to 29; K16 equal to 16; K1 equal to 1.0; A5 equal to −0.25; T1 equal to −1 and S equal to 2. A1, A2, A3 and A4 are all equal to 0.

The use of the value −0.25, as previously explained, converts the cosine function in the denominator of Eq. (2) to a sine function as indicated in Eq. (10). This conversion is carried out as follows. Normally, the domain of a sinusoid is between 0 and $2\pi$ with a range of −1 to +1. Since the sine table 11 of FIG. 1 is referenced by binary numbers, it is convenient to express the angles in terms of rotations rather than radians. Accordingly, an angle goes from −1 to +1 (corresponding to a radian angle of $-\pi$ to $+\pi$). The angle of −0.25 thus corresponds to $-\pi/2$ which is the equivalent of $3\pi/2$ which is the angle required to convert +sin(x) into −cos(x).

During the initialization sequence, the locations DA1 through DA5 of the scratch pad memory 8 are loaded with the following numbers (in binary notation):

DA1←0.045056

DA2←0

DA3←−0.405504

DA4←0.360448

DA5←0.045056

These DA1 through DA5 numbers come from the frequency 440 Hz. Since (for DA1 and DA2) in one second, we must make 440 rotations, and one rotation corresponds to a sweep from −1 to +1 in angle (a total sweep of 2 units), then the amount we must add to the angle at each sample is then 2*frequency/sampling rate, or 2*440/19531.25 which equals 0.045056 (A1←0.045056). Likewise, for the angle $\theta-\beta$, that is 440—440, or zero (A2←0). For the angle $\theta+N\beta$ we use 2*(−440−8*440)/19531.25=−0.405504. The reason we use a negative angle is that we must subtract this sinusoid, and the device has no subtraction hardware. We will make the sinusoid negative simply by making the angle negative, knowing that sine(−x)=−sine(x). For the angle $\theta+(N-1)\beta$ we have 2*(440+7*440)/19531.25=0.360448.

With the above initialization, a first iteration, [It(1)], of the TABLE I sequence is set forth in the following TABLE II.

TABLE II

| | | | | | |
|---|---|---|---|---|---|
| S1 | (A1) | → AL1 | | | 0 → AL1 |
| S2 | (DA1) | → AL2 | | | 0.045056 → AL2 |
| S3 | ADRD | → (A1) | → SL | | 0.045056 → (A1) → sine table address |
| S4 | (A2) | → AL1 | | | 0 → AL1 |
| S5 | (DA2) | → AL2 | | | 0 → AL2 (is zero because Fm = Fc so Fm − Fc = 0) |
| S6 | ADRD | → (A2) | | | 0 → (A2) |
| S7 | (A3) | → AL1 | | | 0 → AL1 |
| S8 | (DA3) | → AL2 | | | −0.405504 → AL2 |
| S9 | ADRD | → (A3) | | | −0.405504 → (A3) |
| S10 | SRD | → (T1) | | | sine(0.045056 rotations) = 0.141075403 → (T1) |
| S11 | (A2) | → SL | | | 0 → sine table address |
| S12 | (A4) | → AL1 | | | 0 → AL1 |
| S13 | (DA4) | → AL2 | | | 0.360448 → AL2 |
| S14 | ADRD | → (A4) | | | 0.360448 → (A4) |
| S15 | (A5) | → AL1 | | | −0.25 → AL1 |
| S16 | (DA5) | → AL2 | | | 0.045056 → AL2 |
| S17 | ADRD | → (A5) | | | −0.204944 → (A5) |
| S18 | SRD | → (T2) | → ML1 | | 0 → (T2) → multiplier |
| S19 | RATRD | → (T2) | → ML2 | | 0 → (T2) → multiplier |
| S20 | (K29) | → ML3 | | | 29 → multiplier shift counter |

It is appropriate here to interrupt the procedure and explain a bit about the control functions and the multiplier scale factor.

First, the multiplier scale factor is the number of steps in a multiply. For instance, to do a full 16 by 16 bit multiply would take 31 steps. it takes 31 rather than 32 steps because each 16-bit number is considered to be a 2s complement signed number thus there are only 30 significant (binary) digits and one sign bit, making 31 in all. In this case, we want the number to have two bits of integer part and 13 bits of fraction part (and one bit of sign), so we specify a multiplier shift count of only 29, which is like dividing the result by four. This gives us two binary places to the left of the ficticious decimal point. We are operating in what would be called a sliding binary fixed point.

About the control functions, the first segment of the piecewise-linear segment for the ratio (index) function is 30 milliseconds long and goes from zero to 0.82. 30 milliseconds at a clock rate of 19531.25 Hz is about 586 samples, so at each sample, the ratio will get bigger by 0.82/586, or 0.00139931741. On this first sample, however, the ratio is zero.

| | | | |
|---|---|---|---|
| S21 | (A3) | → SL | −0.405504 → sine table address |
| S22 | (T2) | → LL | 0 → log table address. |

Note that the log of zero is minus infinity. To take care of this, the log table just returns the smallest negative number (which is as close to infinity as we can get). The log table is set up to take numbers as high as 4.0. This means that in a 16 bit binary number, the decimal point must be considered as being between the third and fourth bits. Since the log of 4.0 is 1.38629436 and since the log of TABLE II-continued 2 ↑ (−16) is −9.70406053 (which is less than 16), the binary point of the output of the log table must be between the fourth and fifth bits

| | | | | | |
|---|---|---|---|---|---|
| S28 | SRD | → (T5) | | | sine(−.405504 rotations) = −0.95625739 → (T5) |
| S29 | LRD | → (T3) | | | log (0) = −∞, the smallest negative number |
| S30 | MRD | → (T4) | → | AL1 | 0*0 = 0 → (T4) → adder latch |
| S31 | (T3) | → ML1 | | | −∞ → multiplier latch |
| S32 | (N) | → ML2 | | | 8 → multiplier latch |
| S33 | (K16) | → ML3 | | | 16 → multiplier step count |

A step count of 16 would be an integer multiply. Since N is an integer (is greater than 1.0), rather than a fraction (which would be considered less than 1.0), an integer multiply is what is needed. Remember that a multiplier produces a 31-bit product. We must select which 16 bits will be taken as the output. If we select the low order 16 bits, the multiply is an integer multiply and the decimal point can be considered as being to the right of the low-order bit. If we select the high-order 16 bits, the multiply is a fractional multiply and the decimal point can be considered as being to the right of the sign bit. A step count of 31 gives us the high order bits and a step count of 16 gives us the low-order bits.

Since the maximum log can be −9.70406053 and the maximum value of N (in this implementation) can be 25, the maximum result of this multiply could be about −250. This would require 8 bits of integer part, thus the scale factor of exactly 8 would give 8 bits of integer part, 7 bits of fraction, and one bit of sign. The exponential table, of course, must be prepared to accept this balance of integer and fractional parts.

| | | | | | |
|---|---|---|---|---|---|
| S34 | (T1) | → AL2 | | | sine(0.045056) = 0.141075403 → adder latch |
| S35 | ADRD | → (T1) | | | 0 + 0.141075403 = 0.141075403 → (T1) |
| S36 | (A4) | → SL | | | 0.360448 → sine table address |
| S38 | MRD | → (T4) | → | EXL | −∞ times anything is still −∞ → exponential table address |
| S41 | (T2) | → ML2 | | | 0 → multiplier |
| S42 | SRD | → (T4) | → | ML1 | sine(0.360448) = .90545412 → multiplier |
| S43 | (K29) | → ML3 | | | 29 steps, gives two binary places for integer part |
| S44 | (A5) | → SL | | | −.204944 → sine table address |
| S50 | (T5) | → AL1 | | | sine(A3 = −.405504) = −.95625739 → adder latch one |
| S51 | SRD | → (T5) | | | sine(A5 = −.204944) = −.600279527 |
| S52 | MRD | → (T4) | → | AL2 | 0*.905425412 = 0 → adder latch |
| S53 | EXRD | → (T4) | → | ML1 | the exponential of −∞ is zero, so 0 → multiplier |
| S54 | ADRD | → (T4) | → | ML2 | −.95625739+0 = −.95625739 → multiplier |
| S55 | EXSCL | → (T4) | → | ML3 | use the exponential scale factor as step count |

Since the dynamic range of the exponential is quite large, the exponential table puts out not only a fraction but also a scale factor that is in exactly the right format to go into the multiplier step count. This gives us sort of a "floating point" representation for these transformation tables. Otherwise, it would be impossible to handle the dynamic range implies by inverses and exponentiation with 16-bit integer arithmetic. The extra scale factor stored in the transform tables gives us this extra dynamic range and the scaling itself is done in the multiplier.

| | | | | | |
|---|---|---|---|---|---|
| S64 | MRD | → (T4) | → | AL1 | 0*anything = 0 → adder |
| S65 | (T2) | → ML1 | | | 0 → multiplier |
| S66 | (T2) | → ML2 | | | again (squaring the ratio) |
| S67 | (K29) | → ML3 | | | two binary points for the integer portion |
| S68 | (T1) | → AL2 | | | sine(A1 = 0.045056) = 0.141075403 → adder |
| S69 | ADRD | → (T1) | | | 0+0.141075403 = 0.14105403 → (T1) |
| S76 | MRD | → (T4) | → | Al1 | 0 times anything is still zero → adder |
| S77 | (T5) | → ML1 | | | sine(A5 = −.204944) = −.600279527 → multiplier |
| S78 | K29 | → ML3 | | | 29 steps gives us two places |
| S79 | (K1) | → AL2 | | | 1.0 → adder (all ones except sign bit) |
| S80 | ADRD | → (T4) | → | AL1 | 0+1 = 1 → adder again |
| S87 | MRD | → (T4) | → | AL2 | 0 times anything is still zero, 0 → adder |
| S88 | ADRD | → (T4) | → | INL | 0+1 = 1 → inverse table address |
| S89 | (T1) | → ML1 | | | 0.141075403 → multiplier (is numerator) |
| S96 | INRD | → (T4) | → | ML2 | inverse of 1.0 is 1.0, so 1.0 → multiplier |
| S97 | INSCL | → (T4) | → | ML3 | scale of 31 will come out of the table this time |
| S105 | MRD | → (T4) | → | ML1 | take the quotient (numerator times inverse of denom.) |
| S106 | AMPRD | → (T4) | → | ML2 | Get amplitude factor, initially zero, so 0 → multiplier |
| S107 | (K31) | → ML3 | | | Full fractional multiply |
| S116 | MRD | → (T4) | → | DAC | 0*anything = 0 so 0 → DAC. First sample is zero |

The results of the first iteration It (1), causes a O to be gated to the converter 16 of FIG. 1 and hence the voltage, V at It (1) equals zero. The scratch pad memory locations A1, . . . , A4 after the first iteration are:

A1=0.045056

A2=0

A3=−0.405504

A4=0.360448

A5=−0.204944

A second iteration, It (2), of the TABLE I sequence is set forth in the following TABLE III.

TABLE III

| | | | | |
|---|---|---|---|---|
| S1 | (A1) | → AL1 | | 0.045056 → AL1 |
| S2 | (DA1) | → AL2 | | 0.045056 → AL2 |
| S3 | ADRD | → (A1) | → SL | 0.090112 → (A1) → sine table address |
| S4 | (A2) | → AL1 | | 0 → AL1 |
| S5 | (DA2) | → AL2 | | 0 → AL2 |
| S6 | ADRD | → (A2) | | 0 → (A2) |
| S7 | (A3) | → AL1 | | −0.405504 → AL1 |
| S8 | (DA3) | → AL2 | | −0.405504 → AL2 |
| S9 | ADRD | → (A3) | | −0.811008 → (A3) |
| S10 | SRD | → (T1) | | sine(0.090112) = 0.279328976 → (T1) |
| S11 | (A2) | → SL | | 0 → sine table address |
| S12 | (A4) | → AL1 | | 0.360448 → AL1 |
| S13 | (DA4) | → AL2 | | 0.360448 → AL2 |
| S14 | ADRD | → (A4) | | 0.720896 → (A4) |
| S15 | (A5) | → AL1 | | −0.204944 → AL1 |
| S16 | (DA5) | → AL2 | | 0.045056 → AL2 |
| S17 | ADRD | → (A5) | | −0.159888 → (A5) |
| S18 | SRD | → (T2) | → ML1 | 0 → (T2) → multiplier |
| S19 | RATRD | → (T2) | → ML2 | 0.00279863482 → (T2) → multiplier |
| | As mentioned before, this first segment of the piecewise-linear segment for the ratio (index) function is 30 milliseconds long and goes from zero to 0.82. 30 milliseconds at a clock rate of 19531.25 Hz is about 586 samples, so at each sample, the ratio will get bigger by 0.82/586, or 0.00139931741. | | | |
| S20 | (K29) | → ML3 | | 29 → multiplier shift counter |
| S21 | (A3) | → SL | | −0.811008 → sine table address |
| S22 | (T2) | → LL | | 1(2) = 0.00279863482 → log table address. |
| S28 | SRD | → (T5) | | sine(−.811008) = −0.559461431 → (T5) |
| S29 | LRD | → (T3) | | log(0.00279863482) = −5.87862354 |
| | Note that there are four places in the integer part of the log output. | | | |
| S30 | MRD | → (T4) | → AL1 | 0*anything = 0 → (T4) → adder latch |
| S31 | (T3) | → ML1 | | −5.87862354 → multiplier latch |
| S32 | (N) | → ML2 | | 8 → multiplier latch |
| S33 | (K16) | → ML3 | | 16 → multiplier step count |
| S34 | (T1) | → AL2 | | sine(0.090112) = 0.279328976 → adder latch |
| S35 | ADRD | → (T1) | | 0 + 0.279328976 = 0.279328976 → (T1) |
| | We accumulate the numerator in (T1) | | | |
| S36 | (A4) | → SL | | 0.720896 → sine table address |
| S38 | MRD | → (T4) | → EXL | −5.87882354*8 = −47.0289883 → exponential table address |
| | Remember that we have 8 bits of integer part here so this number does not overflow. | | | |
| S41 | (T2) | → ML2 | | 0.00279863482 → multiplier |
| S42 | SRD | → (T4) | → ML1 | sine(0.720896) = .768715927 → multiplier |
| S43 | (K29) | → ML3 | | 29 steps, gives two binary places for integer part |
| S44 | (A5) | → SL | | −.159888 → sine table address |
| S50 | (T5) | → AL1 | | sine(A3 = −.811008) = −.559461431 → adder latch one |
| S51 | SRD | → (T5) | | sine(A5 = −.159888) = −.481445308 |
| S52 | MRD | → (T4) | → AL2 | 0.768715927*0.00279863482 = 0.00215135516 → adder |
| S53 | EXRD | → (T4) | → ML1 | e ↑ (−47.0289883) = essentially zero, so 0 → multiplier |
| S54 | ADRD | → (T4) | → ML2 | −.559461431 + 0.00215135516 = −.557310076 → multiplier |
| S55 | EXSCL | → (T4) | → ML3 | use the exponential scale factor as step count |
| S64 | MRD | → (T4) | → AL1 | 0*anything = 0 → adder |
| S65 | (T2) | → ML1 | | 0.00279863482 (the ratio, I(2)) → multiplier |
| S66 | (T2) | → ML2 | | again (squaring the ratio) |
| S67 | (K29) | → ML3 | | two binary points for the integer portion |
| S68 | (T1) | → AL2 | | sine(A1 = 0.090112) = 0.279328976 → adder |
| S69 | ADRD | → (T1) | | 0 + 0.279328976 = 0.279328976 → (T1) |

TABLE III-continued

| | | | | | |
|---|---|---|---|---|---|
| S76 | MRD | → (T4) | → AL1 | | 0.00279863482 ↑ 2 = 0.00000783235686 |
| S77 | (T5) | → ML1 | | | sine(A5 = −.159888) = −.481445308 → multiplier |
| S78 | K29 | → ML3 | | | 29 steps gives us two places |
| S79 | (K1) | → AL2 | | | 1.0 → adder (all ones except sign bit) |
| S80 | ADRD | → (T4) | → AL1 | | 1 + 0.00000783235686 = 1.0000078325686 → adder |
| | | | | | Notice that since the smallest number that is contained in a 15-bit fraction is only about 0.000015, the number 0.00000783235686 would be truncated to zero. We carry it along here just for illustration purposes. We will take it as zero in the following computations, so the output of the adder is then exactly one (in this case). |
| S87 | MRD | → (T4) | → AL2 | | 0.00279863482*(−.481445308) = −0.0013473896 → adder |
| S88 | ADRD | → (T4) | → INL | | −0.0013473896 + 1 = .99865261 → inverse table address |
| S89 | (T1) | → ML1 | | | 0.279328976 → multiplier (is numerator) |
| S96 | INRO | → (T4) | → ML2 | | inverse of 0.99865261 is 1.00134921 → multiplier |
| S97 | IMSCL | → (T4) | → ML3 | | scale of 30 will come out of the table this time, >1 |
| S105 | MRD | → (T4) | → ML1 | | take the quotient (numerator times inverse of denom.) 0.279328976*1.08134921 = .279705849 |
| S106 | AMPRD | → (T4) | → ML2 | | Get amplitude factor (with normalization factor) or 0.5805777/586 =0.00090746928 →multiplier |
| S107 | (K31) | → ML3 | | | Full fractional multiply |
| S116 | MRD | → (T4) | → DAC | | 0.00090746928*.279705849 = 0.000253824465 |

After the iteration It(1) and It(2), set forth in detail above, subsequent iterations It(3), . . . are carried out for the duration of the musical sound. Since the brass-like tone was specified to be 330 milliseconds in duration, it takes 6,445 iterations of the TABLE I sequence to form the output wave form. The wave form produced during the iterations of the TABLE I sequence is shown in FIG. 3.

Figure 7:
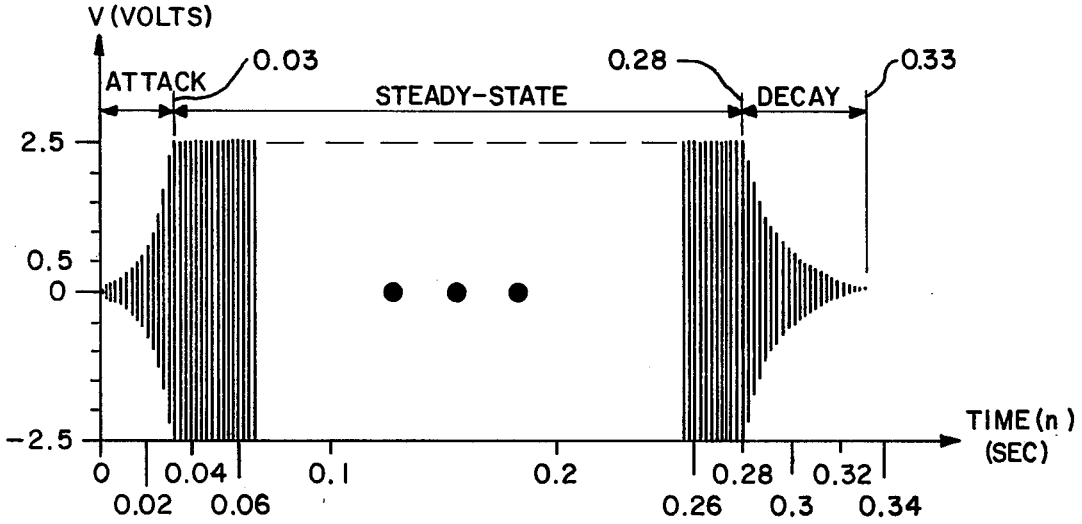
FIG. 7 depicts a wave form representative of the signal to the audio output and representative of one tone generated by the musical instrument of FIG. 1.

In FIG. 7, the whole brass-like tone wave form is shown having a total duration of 330 milliseconds. The attack portion of the wave form occurs during the first 30 milliseconds (0.03 seconds). The steady-state portion is present between 0.03 seconds and 0.28 seconds. The decay portion is present between 0.28 and 0.33 seconds.

Further details of the attack portion of the FIG. 7 wave form are shown in FIG. 8.

Figure 9:
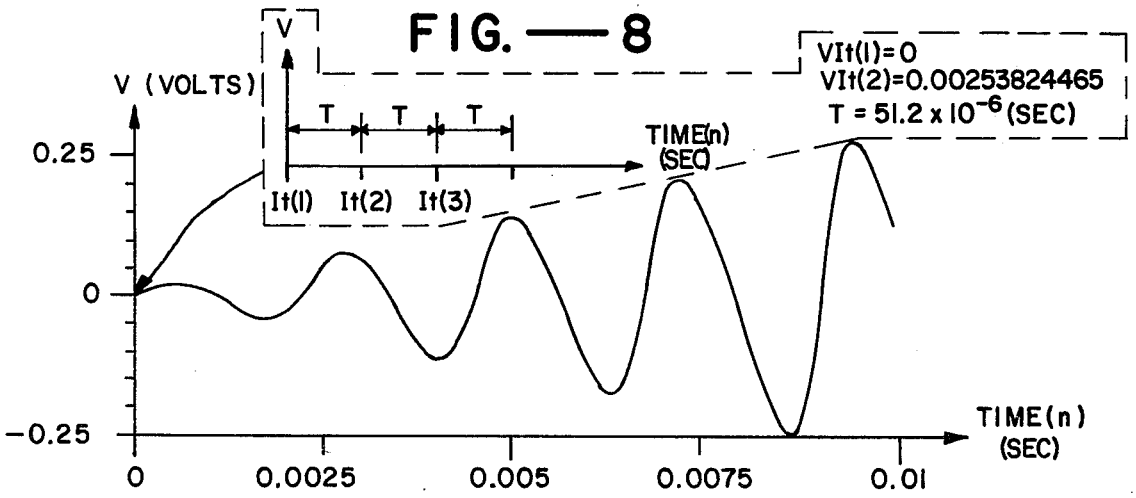
FIG. 9 depicts an expanded scale view of a portion of the FIG. 8 wave form.

In FIG. 9, an expanded scale of the wave form of FIG. 8 is shown. In FIG. 9, the results of the first two iterations, It(1) and It(2), as discussed above in connection with TABLE I, occur at 51.2 microsecond sample periods (SP) and are shown in the expanded view from FIG. 9.

Figure 10:
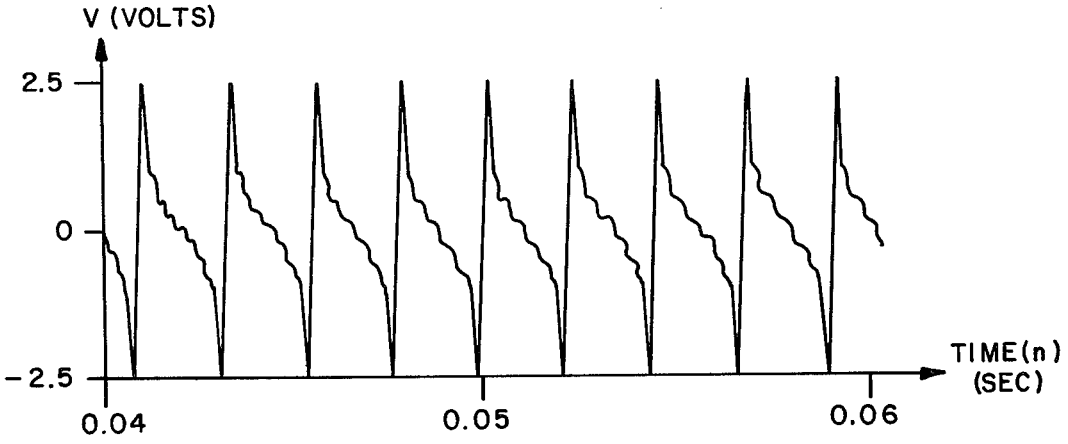
FIG. 10 depicts an expanded scale view of a portion of the steady-state portion of the wave form of FIG. 7.
Figure 11:
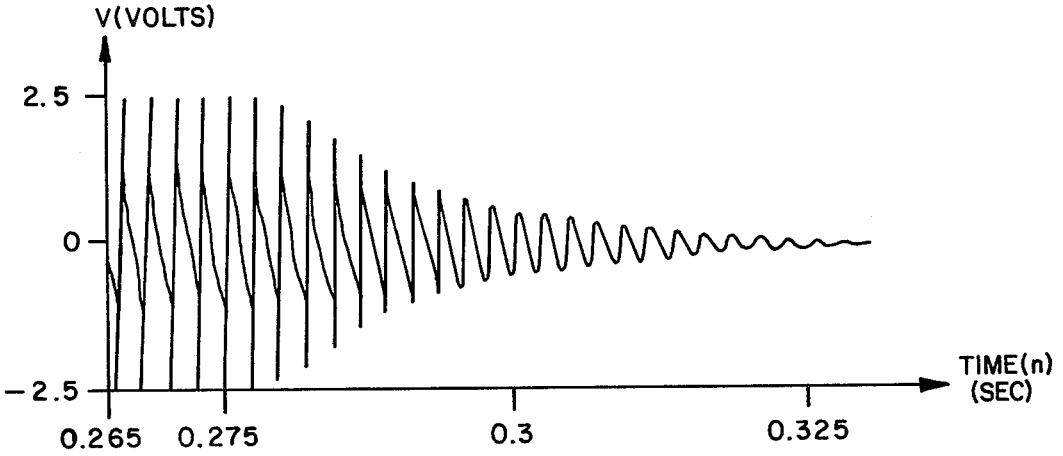
FIG. 11 depicts an expanded scale view of the decay portion of FIG. 7 wave form.

In FIG. 10, a portion of the steady-state portion of the FIG. 7 wave form is shown in expanded scale. In FIG. 11, the decay portion of the wave form is shown in detail.

The 6,445 iterations of the TABLE I sequence are executed to form the output wave form depicted in the FIGS. 7 through 11. When signals of the type represented by the wave form in FIGS. 7 through 11 are presented to the audio output device 15, a musical sound having a brass-like tone is heard.

Further and Other Embodiments

While the present invention has been described with respect to a number of different sequences for producing monophonic tones, the invention also encompasses polyphonic tones. The creation of polyphonic tones occurs, for example, by duplicating all of the circuitry between keyboard 3 and audio output device 15 of FIG. 1. The duplication occurs once for each different tone that is to be produced concurrently. While duplication of circuitry is possible, it is also possible to time share the FIG. 1 circuitry for concurrent generation of polyphonic sound. When time sharing occurs, it is required that the iteration for each tone sequence (of the TABLE I type) be completed so that the sampling frequency for each tone is sufficiently high (e.g. 16 KHz) to provide for quality tone generation. The particular sequence described in TABLE I above is particularly long and hence requires a long time for execution. Sequences based upon other ones of the Eqs. (1) through (7b) can be executed in shorter times and hence can be utilized for polyphonic tone generation with greater efficiency.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A musical instrument for producing musical sound comprising, a keyboard for specifying a frequency and duration of a musical sound to be generated, an initial data memory storing initial data and responsive to the keyboard for initializing the musical instrument, a spectral control unit for storing a time-varying spectral index, an amplitude control unit for storing a time-varying amplitude index, a first function memory for storing data for a first function, a second function memory for storing data for a second function when said second function is non-linear and is different from said first function, arithmatic means for combining signals from said memories and units, control means for providing control signals to said memories, units and arithmatic means in accordance with a control sequence to produce periodically digital signals as the non-linear transformation of said first function by said second function and where said digital signals specify an amplitude controlled by said amplitude index and a frequency spectra controlled by said spectral index, means for generating musical sound in response to said digital signals whereby the musical sound has an amplitude and component frequencies determined by the amplitude and frequency spectra of said digital signals.

2. The apparatus of claim 1 wherein said first function memory includes means for storing values of a sinusoid and where said control means includes means for accessing said first function memory periodically to obtain values of a sinusoid varying with a center frequency Fc where Fc is in the audio range.

3. The apparatus of claim 1 wherein said second function memory includes means for storing values of a non-linear function different from the function stored in said first function memory and where said control means includes means for accessing said second function memory periodically to obtain values of said second function varying with a modifying frequency Fm where Fm is in the audio range.

4. The apparatus of claim 1 wherein said second function memory includes means for storing said second function in the form 1/z where z includes a sinusoid varying with a modifying frequency Fm where Fm is in the audio range.

5. The apparatus of claim 1 wherein said first function memory includes means for storing values of a sinusoid and where said control means includes means for accessing said first function memory periodically to obtain values of a sinusoid varying with a center frequency Fc and varying with a modifying frequency Fm where Fc and Fm are in the audio range.

6. The apparatus of claim 1 wherein said second function memory includes means for storing an exponential function and wherein said control means includes means for accessing said second function memory to obtain values of said exponential function.

7. The apparatus of claim 6 wherein values of said exponential function vary with a modifying frequency Fm where Fm is in the audio range.

8. The apparatus of claim 1 wherein said means for generating musical sound includes a digital-to-analog converter for converting said digital signals to analog signals, includes sample and hold means for sampling said analog signal to provide a sample signal, and includes an audio output device having a speaker for producing the musical sound.

9. The apparatus of claim 1 wherein said arithmatic means includes adder means and multiplier means under control of said control unit.

10. A musical instrument for producing musical sound comprising, a keyboard for specifying a frequency and duration of a musical sound to be generated, an initial data memory storing initial data and responsive to the keyboard for initializing the musical instrument, a spectral control unit for storing a time-varying spectral index, an amplitude control unit for storing a time-varying amplitude index, a first function memory for storing data for a first function, a second function memory for storing data for a second function where said second function is a non-linear and is different from said first function, a scratch pad memory, arithmatic means for arithemetically combining signals from said memories and units, control means for providing control signals to said memories, units and arithmatic means in accordance with a control sequence to produce, periodically at a sample period, digital signals as the non-linear transformation of said first function by said second function and where said digital signals determine an amplitude controlled by said amplitude index and a frequency spectra controlled by said spectral index, generator means for generating musical sound in response to said digital signals whereby the musical sound has an amplitude and component frequencies determined by the amplitude and frequency spectra determined by said digital signals, said generator means including means for converting one of said digital signals to an analog signal each sampling period.

11. The apparatus of claim 10 wherein said control means includes store means for storing a plurality of different control sequences each having a number of steps and includes means for selecting said control sequences.

12. The apparatus of claim 11 wherein said control means includes clock means for providing clock pulses establishing a clock rate and includes means for addressing said store means to access the steps in each control sequence at said clock rate, and wherein said number of steps for a selected control sequence are accessed once for each sampling period.

13. The apparatus of claim 12 wherein said scratch pad memory has means for storing a center frequency angle $2\pi(Fc)nT$ and a modifying angle $2\pi(Fm)nT$ where "T" is the sampling period and "n" is time determined by the number of sampling periods, and wherein said control means includes means for incrementing "n" once for each execution of a control sequence.

14. The apparatus of claim 13 including means for accessing said spectral control unit and said amplitude control unit as a function of "n" whereby said spectral index, "I", and said amplitude index, "A", vary as a function of "n".

15. The apparatus of claim 14 wherein digital numbers are defined by a quantity "X" for each value of "n" where:

$$X = A\frac{\sin[2\pi(Fc)nT] - I\sin[2\pi(Fc - Fm)nT]}{1 + I^2 - 2I\cos[2\pi(Fm)nT]}$$

16. The apparatus of claim 15 wherein said first function includes a sinusoid which varies with $[2\pi(Fc-Fm)nT]$ and said second function varies with 1/Z where "Z" includes $(1+I^2-2I\cos[2\pi(Fm)nT])$.

* * * * *